US005526103A

United States Patent [19]

Kato et al.

[11] Patent Number: 5,526,103

[45] Date of Patent: Jun. 11, 1996

[54] INDUCTION HEATING FIXING DEVICE

[75] Inventors: Takeshi Kato, Toyokawa; Satoru Yoneda, Toyohashi; Eiji Okabayashi, Toyokawa; Peter Johnston, Toyokawa; Hiroaki Hinotani, Toyokawa; Tohru Fujiwara, Machida, all of Japan

[73] Assignee: Minolta Co., Ltd., Osaka, Japan

[21] Appl. No.: 413,770

[22] Filed: Mar. 30, 1995

[30] Foreign Application Priority Data

| | | | |
|---|---|---|---|
| Mar. 31, 1994 | [JP] | Japan | 6-063193 |
| Aug. 3, 1994 | [JP] | Japan | 6-182379 |
| Aug. 19, 1994 | [JP] | Japan | 6-195584 |

[51] Int. Cl.[6] ..... G03G 15/20

[52] U.S. Cl. ..... 355/285; 355/782; 219/216; 219/619; 219/667

[58] Field of Search ..... 355/285, 289, 355/290, 282, 291, 286, 287; 219/619, 667, 662, 670–671, 469–471, 216

[56] References Cited

U.S. PATENT DOCUMENTS

| | | | |
|---|---|---|---|
| 3,809,855 | 5/1974 | Neal | 219/216 |
| 4,570,044 | 2/1986 | Kobayashi et al. | 219/216 X |
| 5,074,019 | 12/1991 | Link | 219/471 X |
| 5,303,016 | 4/1994 | Oda et al. | 355/289 |
| 5,393,959 | 2/1995 | Kitano et al. | 219/619 |

FOREIGN PATENT DOCUMENTS

| | | | |
|---|---|---|---|
| 0133466 | 8/1982 | Japan . | |
| 0205766 | 12/1982 | Japan . | |
| 58-178385 | 10/1983 | Japan . | |
| 0306585 | 10/1992 | Japan | 219/619 |
| 0306588 | 10/1992 | Japan | 219/619 |
| 0135867 | 6/1993 | Japan | 219/619 |

*Primary Examiner*—Matthew S. Smith

*Attorney, Agent, or Firm*—Willian Brinks Hofer Gilson & Lione

[57] ABSTRACT

An induction heating fixing device comprises a heat roller in which coil assemblies are disposed. The coil assemblies are aligned axially of the roller to produce magnetic flux in a direction orthogonal to the axis of the heat roller.

10 Claims, 28 Drawing Sheets

FIG. 16 Reference Example
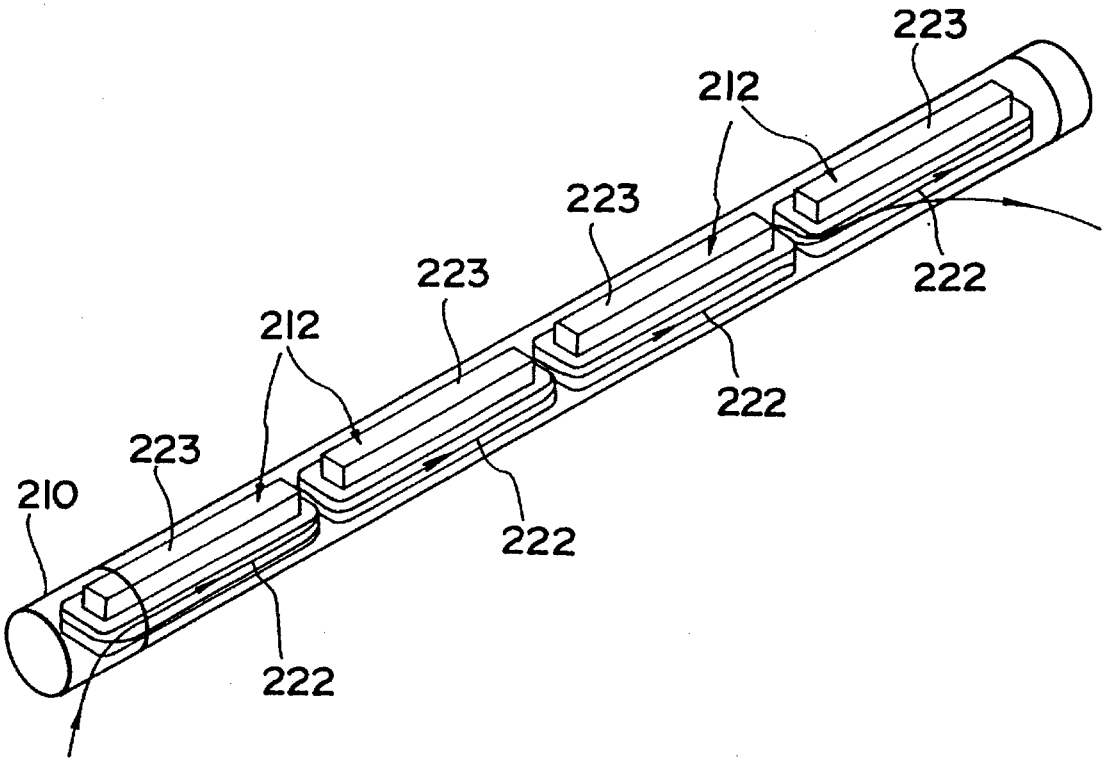

Reference Example

FIG. 18 Reference Example
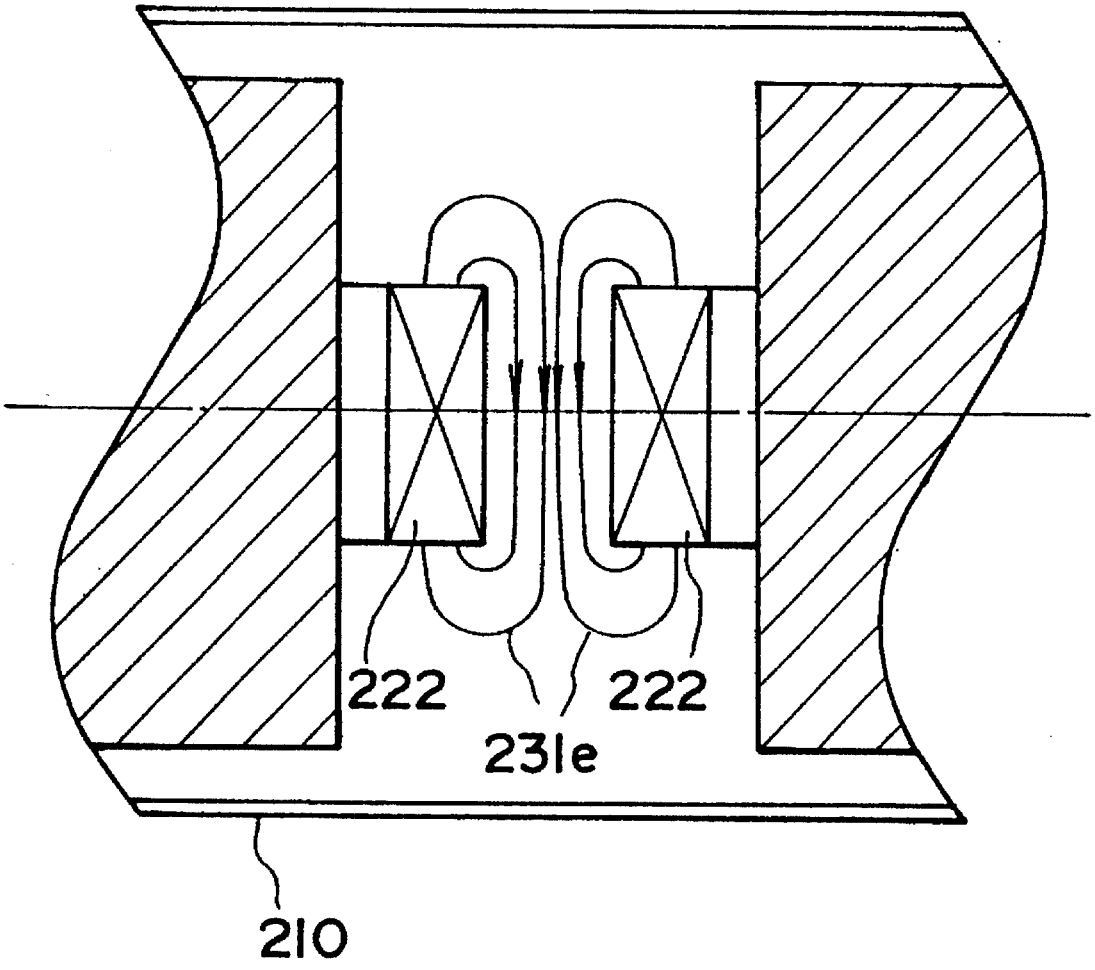

INDUCTION HEATING FIXING DEVICE

BACKGROUND OF THE INVENTION

1. Field of the Invention

The present invention relates to fixing devices for use in copying machines, printers and facsimile apparatus, and more particularly to devices for fixing toner images to recording media such as paper and OHP sheets, utilizing induction heating.

2. Description of the Related Art

Conventionally, copying machines and the like have incorporated therein a device for fixing a toner image to a sheet bearing the image as transferred thereto. The fixing device comprises, for example, a heat roller for melting the toner on the sheet, and a pressure roller in pressing contact with the heat roller for nipping the sheet therebetween. The heat roller is in the form of a hollow cylinder and includes a heater held on the center axis of the roller inside thereof by holder means. The heater comprises, for example, a halogen lamp and is adapted to generate heat with a specified voltage applied thereto. The heater is positioned on the center axis of the heat roller and therefore radiates heat uniformly on the roller inner wall, giving the roller outer wall a temperature distribution which is uniform circumferentially of the roller. The outer wall of the heat roller is heated until the temperature thereof reaches a level (e.g., 150° to 200° C.) suited to fixing. In this state, the heat roller and the pressure roller in contact therewith rotate in directions opposite to each other to nip the toner-bearing sheet between the rollers. At the portion of contact between the heat roller and the pressure roller (hereinafter referred to as the "nip"), the toner on the sheet is melted by the heat of the heat roller and fixed to the sheet. With the rotation of the two rollers, the sheet is thereafter transported by a discharge roller and delivered onto a discharge tray.

The fixing device described requires a relatively long period of time for the heat roller to reach the temperature suited to fixing after the power supply for the copying machine has been turned on. This entails the problem that the user, unable to use the copying machine in the meantime, is obliged to wait for a long time.

Accordingly, a fixing device of the induction heating type has been proposed as a device solving the problem (Japanese Laid-Open Patent Application No. 58-178385). This device comprises an open magnetic path iron core provided with a coil concentrically therewith and disposed inside a heat roller of metal conductor. A high-frequency current is passed through the coil which is proximate to the inner surface of the heat roller to set up a high-frequency magnetic field, which induces an eddy current in the heat roller, causing the roller itself to generate Joule heat by virtue of the skin resistance of the roller per se. The device of the induction heating type heats up more rapidly than the device including a halogen lamp or like heater since the heat roller of metal conductor itself generates heat.

However, since the heat roller of the fixing device described produces heat uniformly over the surface, the heat generated by the portion other than the nip for fixing is not used for fixing but is wasted, while an increased supply of current to heat up the nip rapidly results in increased heat generation at the other portion alike, giving rise to another problem in that the internal temperature of the copying machine rises. The result is further in conflict with the recent trend toward savings in energy.

The nip and the neighboring portion thereof are heated to nearly the same temperature by the heat generated over the entire wall area of the heat roller, so that the following problem also arises when the sheet is released from the nip with the rotation of the heat roller.

In the vicinity of the nip, the heat of the heat roller permits the toner to remain melted without fixing to the sheet. The molten toner is therefore liable to adhere to the heat roller, from which the toner is transferred to the sheet again, hence the problem of so-called offset.

Further because the toner remains melted without fixing to the sheet owing to the heat of the heat roller in the vicinity of the nip, the adhesion of the molten toner makes it difficult for the sheet to separate from the portion of the heat roller other than the nip. This leads to the problem that the sheet will wind around the heat roller to cause a jam.

SUMMARY OF THE INVENTION

The main object of the present invention is to provide an induction heating fixing device which is shortened in the time required for heating and which is adapted to obviate offset.

Another object of the invention is to provide an induction heating fixing device which realizes uniform fixing along the direction of the axis of rotation of its heat roller.

These objects of the present invention are filfilled by an induction heating fixing device comprising:

- a heat roller formed by an electrically conductive member and having a hollow space in its interior,
- a pressure roller disposed in pressing contact with the heat roller,
- a core disposed within the heat roller in a direction orthogonal to the axis of rotation of the heat roller,
- a coil provided around the core, and
- a circuit for passing an alternating current through the coil.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

FIG. 16 is a perspective view showing coils as arranged in a reference example;

FIG. 18 is an enlarged diagram showing magnetic flux generated in an air gap portion in the reference example shown in FIG. 16;

DESCRIPTION OF THE PREFERRED EMBODIMENTS

Induction heating fixing devices embodying the present invention will be described below with reference to the accompanying drawings.

Figure 1:
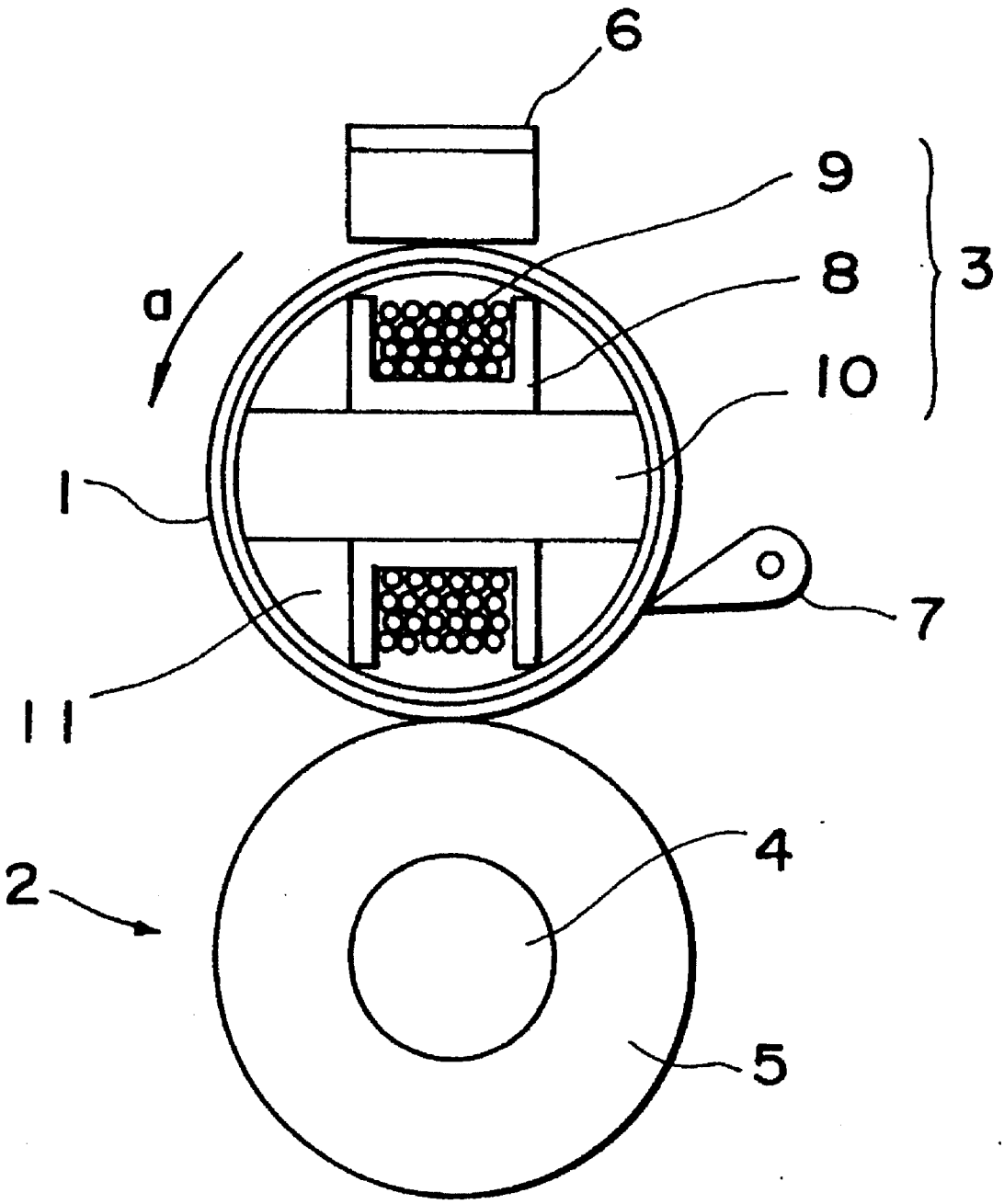
FIG. 1 is a sectional view of an induction heating fixing device embodying the invention.

FIG. 1 is a sectional view showing the construction of one of the fixing devices embodying the invention. The fixing device comprises a heat roller 1 in the form of a hollow cylinder and drivingly rotatable in the direction of arrow a by an unillustrated drive source, and a pressure roller 2 pressed against the heat roller 1 and rotatable by the rotation of the heat roller 1. The heat roller 1 has arranged therein coil assemblies 3 for setting up an induction magnetic field. The heat roller 1 is formed by an electrically conductive member such as a carbon steel pipe, stainless alloy pipe or aluminum alloy pipe and coated with a fluorocarbon resin over the outer periphery thereof. On the other hand, the pressure roller 2 comprises an axial core 4 and a silicone rubber layer 5 formed around the core. Preferably, the heat roller 1 comprises a conductive magnetic member. The drawing shows a thermistor 6 which functions as a temperature sensor for detecting the surface temperature of the heat roller 1, and a separating claw 7 for separating a sheet from the heat roller 2.

Figure 2:
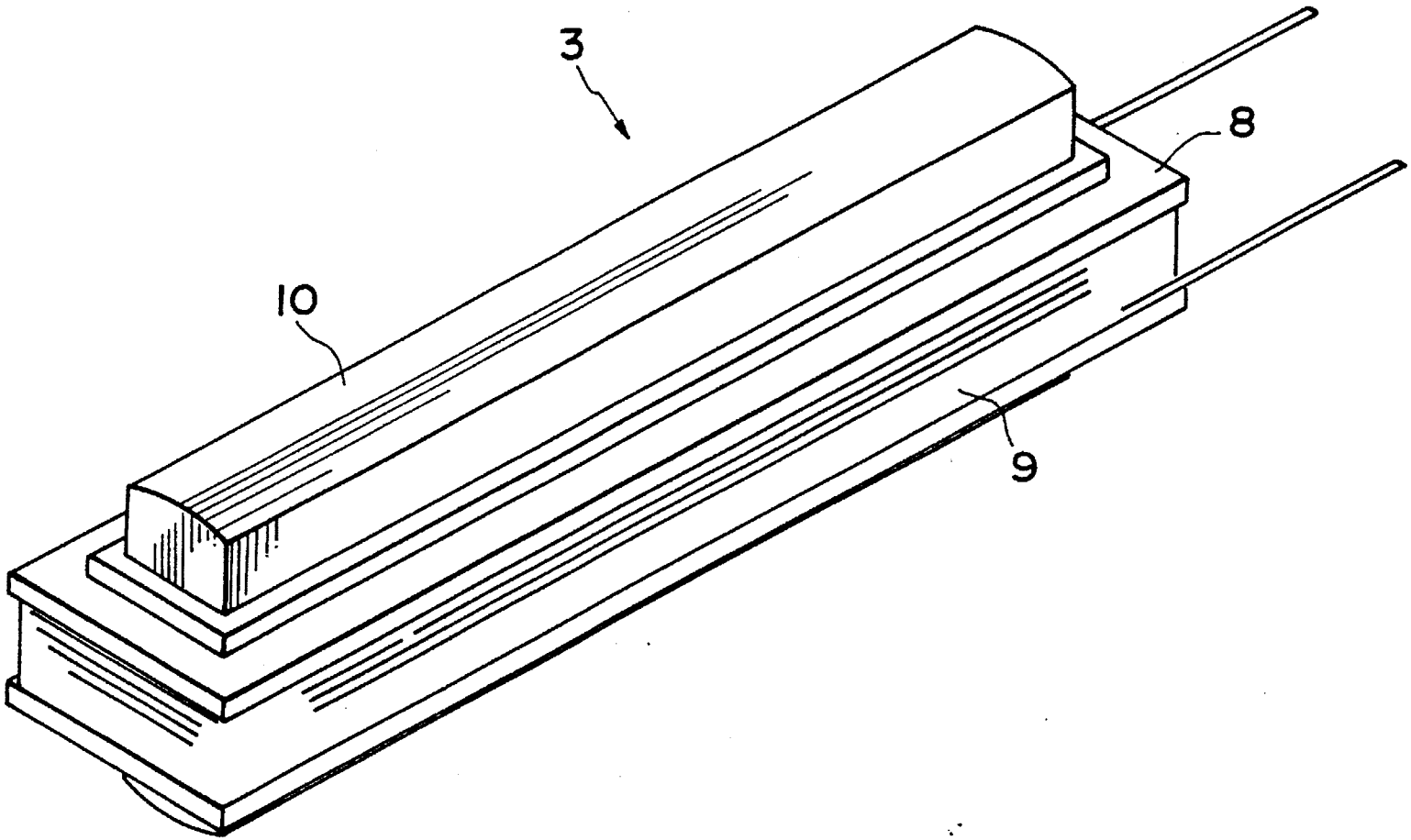
FIG. 2 is a perspective view showing a coil assembly for use in the fixing device of FIG. 1.

As shown in FIG. 2, the coil assembly 3 comprises a bobbin 8 in the form of a rectangular frame having a central opening, and a coil 9 formed by winding a copper wire around the bobbin 8 a plurality of turns in one direction. A core 10 is inserted in the opening of the bobbin 8 so as to be orthogonal to the copper wire of the coil 9. The bobbin 8 may be made, for example, of ceramic or heat-insulating plastic. Preferably, the coil 9 is prepared with use of a copper wire having a fusion layer and insulating layer over the surface. The core 10 can be a single iron core, or may be made by fitting together thin iron plates in superposed layers. The coil assembly 3 is so positioned as to produce magnetic flux in a direction orthogonal to the axis of rotation of the heat roller 1. Stated more specifically, the assembly is so positioned that the turns of the copper wire around the bobbin 8 extend along a plane parallel to the axis of rotation of the heat roller 1, with the core 10 oriented orthogonally to the axis.

Figure 3:
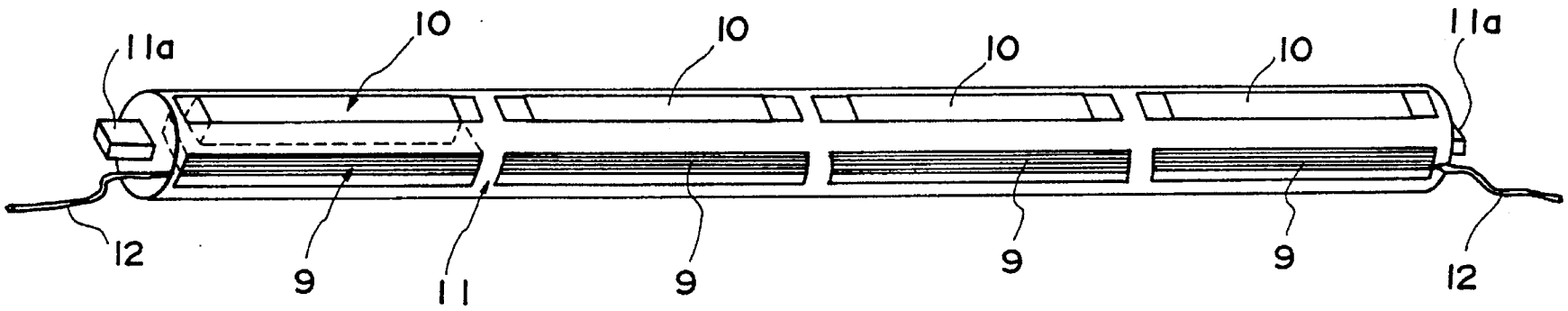
FIG. 3 is a perspective view of a holder for holding the coil assembly shown in FIG. 2.

Further according to the present embodiment as shown in FIGS. 1 and 3, the coil assemblies 3 are aligned axially of the heat roller 1 with use of a holder 11 so that each coil 9 has its one side opposed to the pressure roller 2 and the other side thereof to the thermistor 6, with each core 10 in parallel to the direction of transport of the sheet. The holder 11, which is made of a heat-resistant plastic, is in the form of a cylinder having a plurality of bores extending through its peripheral wall vertically and laterally as seen in FIG. 3, and has at each of opposite ends a projection 11*a* for fixing the holder to the body of the device. Each coil assembly 3 is incorporated into the holder 11, for example, by inserting the bobbin 8 into the lateral bore in the holder 11 and thereafter inserting the core 10 into the vertical bore. The coils 9 are electrically connected together in series inside the holder 11. Extending from each end of the holder 11 is a lead 12 for passing a current through these coils 9 therethrough. The holder 11 has a diameter slightly smaller than the inside diameter of the heat roller 1 so as to form a clearance between the holder 11 and the inner wall of the heat roller 1.

Figure 4:
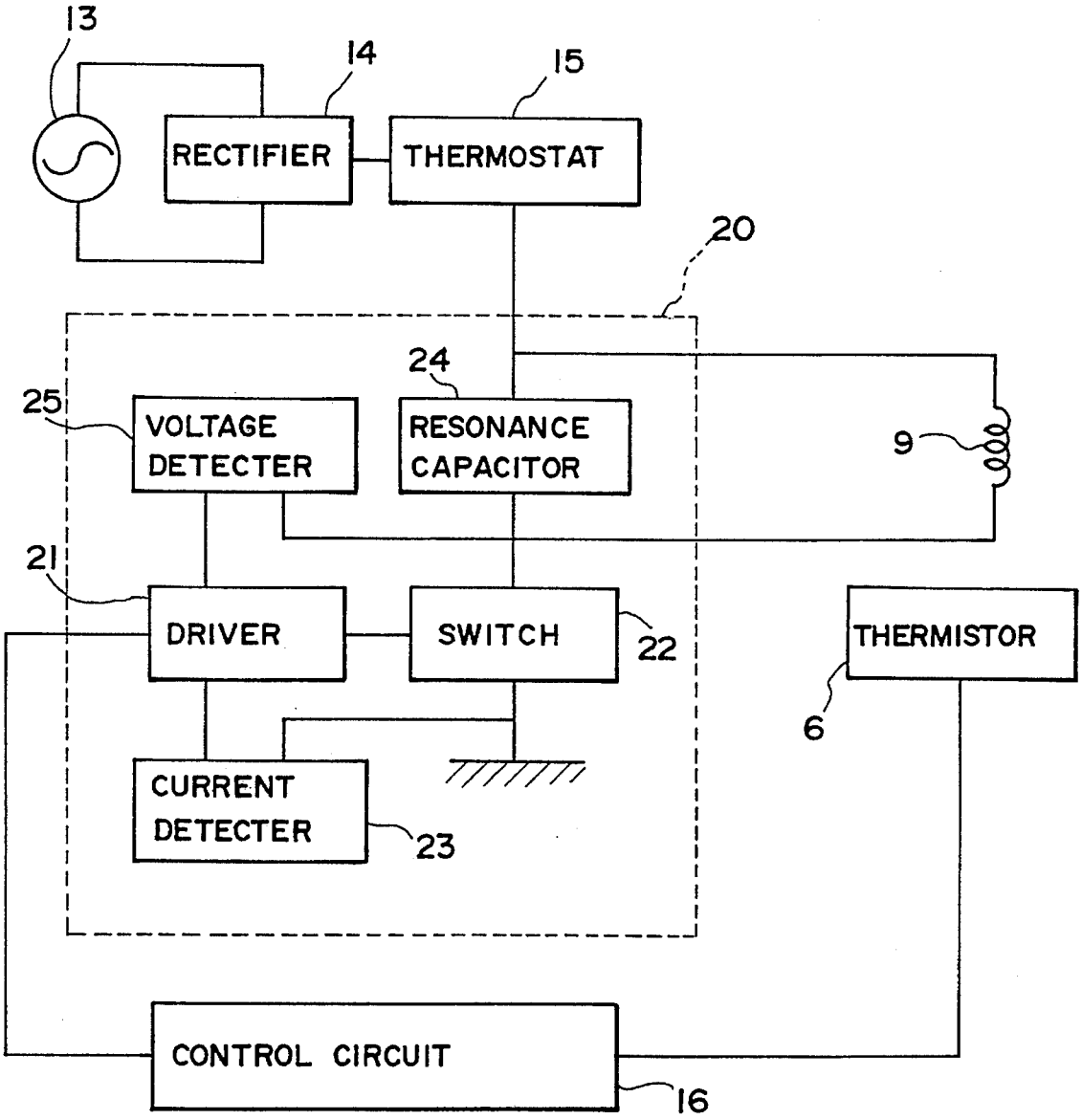
FIG. 4 is a block diagram of a control circuit for passing a high-frequency current through induction heating coils.

FIG. 4 is a block diagram of a circuit for passing a high-frequency current through the induction heating coils 9 and controlling the temperature of the heat roller 1. The high-frequency current is produced by rectifying the alternating current of a commercial power source 13 by a rectifier circuit 14, followed by conversion by an inverter circuit 20. The current to the inverter circuit 20 is supplied via a thermostat 15 which is a temperature fuse pressed in contact with the surface of the heat roller 1. The thermostat 15 functions to cut off the supply of current to the circuit upon the surface temperature of the heat roller 1 reaching a predetermined abnormal temperature and is positioned, like the thermistor 6, as opposed to the coil 9 on the core 10. A control circuit 16, which comprises a microprocessor, memory, etc., effects temperature control by feeding an on/off signal to a drive circuit 21 within the inverter circuit 20 while monitoring the temperature of the heat roller 1 based on the potential of the thermistor 6.

Figure 5A:
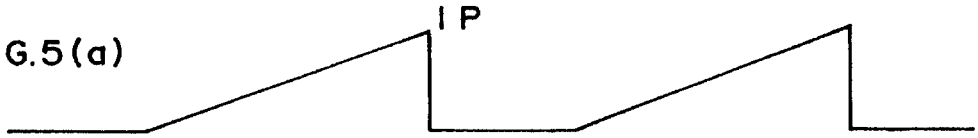
FIG. 5(*a*) is a waveform diagram of the current detected by a current detecting circuit shown in FIG. 4, FIG. 5(*b*) is a waveform diagram of the voltage detected by a voltage detecting circuit shown in FIG. 4, and FIG. 5(*c*) is a waveform diagram of the on/off signal of a switching element shown in FIG. 4.
Figure 5B:
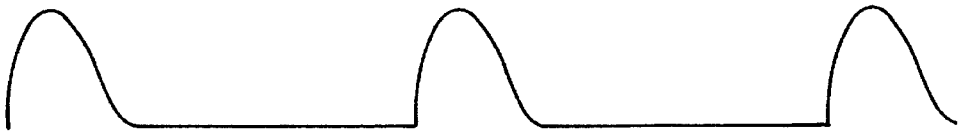
Figure 5C:
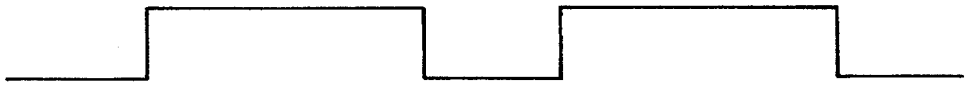
Figure 6:
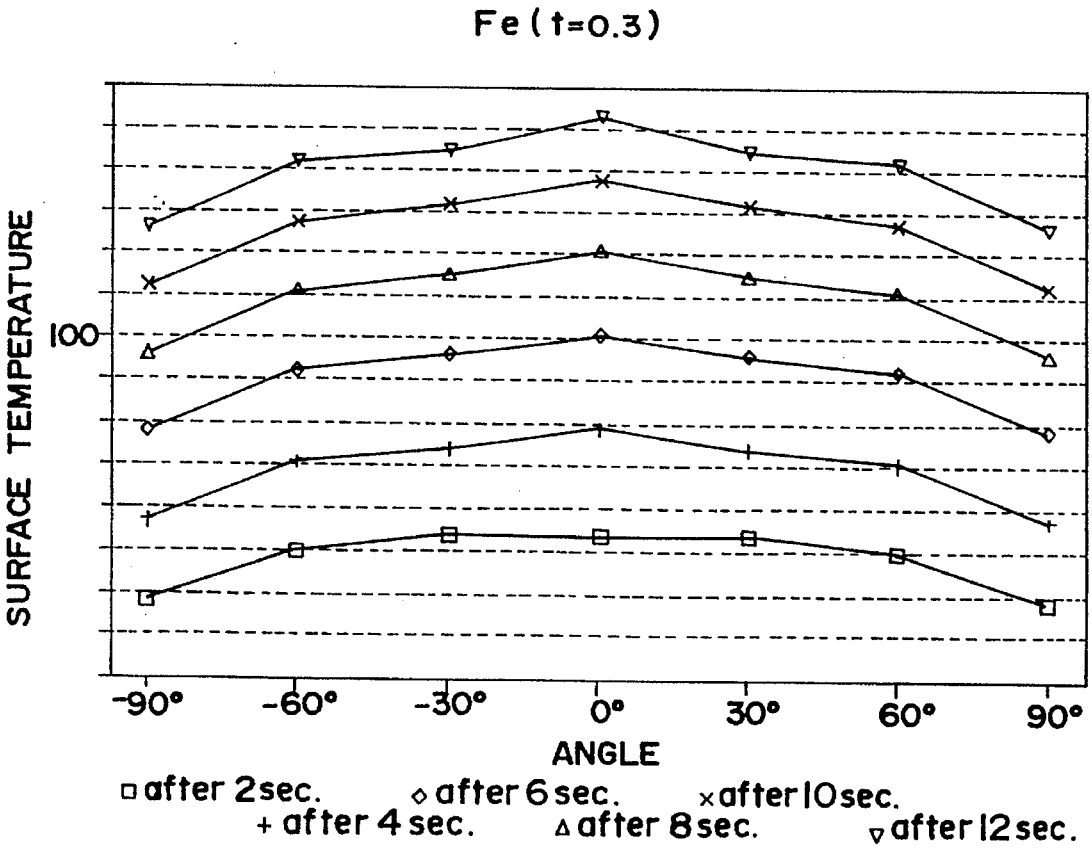
FIG. 6 is a graph showing the result obtained by measuring the surface temperature of a heat roller in the fixing device embodying the invention.
Figure 7:
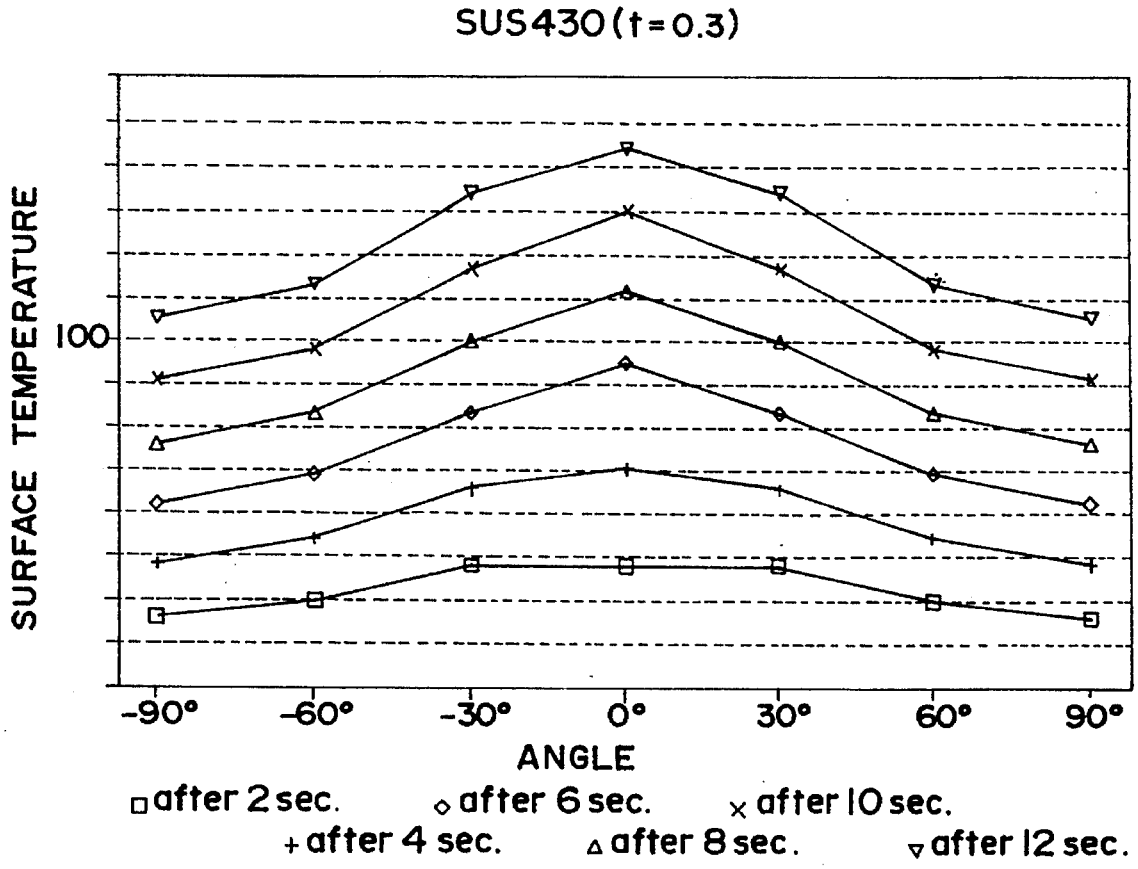
FIG. 7 is a graph showing the result obtained by measuring the surface temperature of another heat roller as used in the fixing device.
Figure 8:
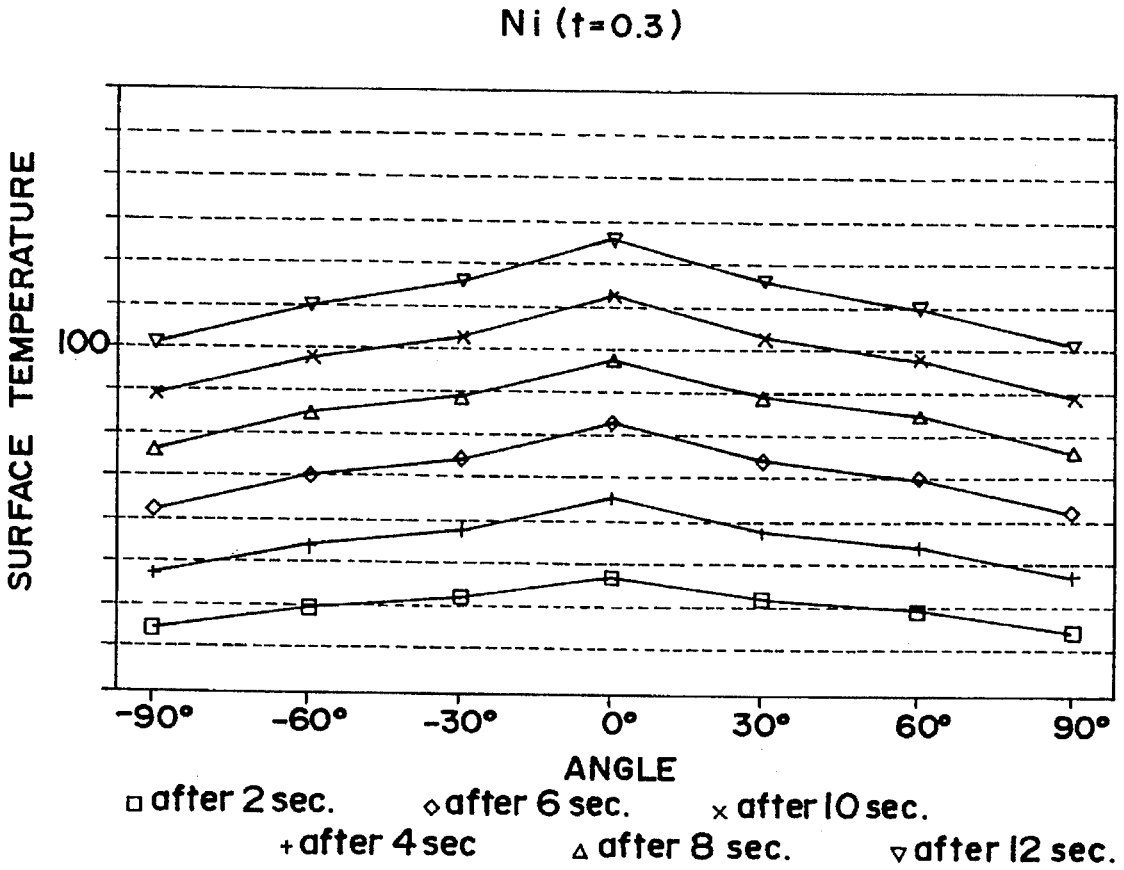
FIG. 8 is a graph showing the result obtained by measuring the surface temperature of another heat roller as used in the fixing device.
Figure 9:
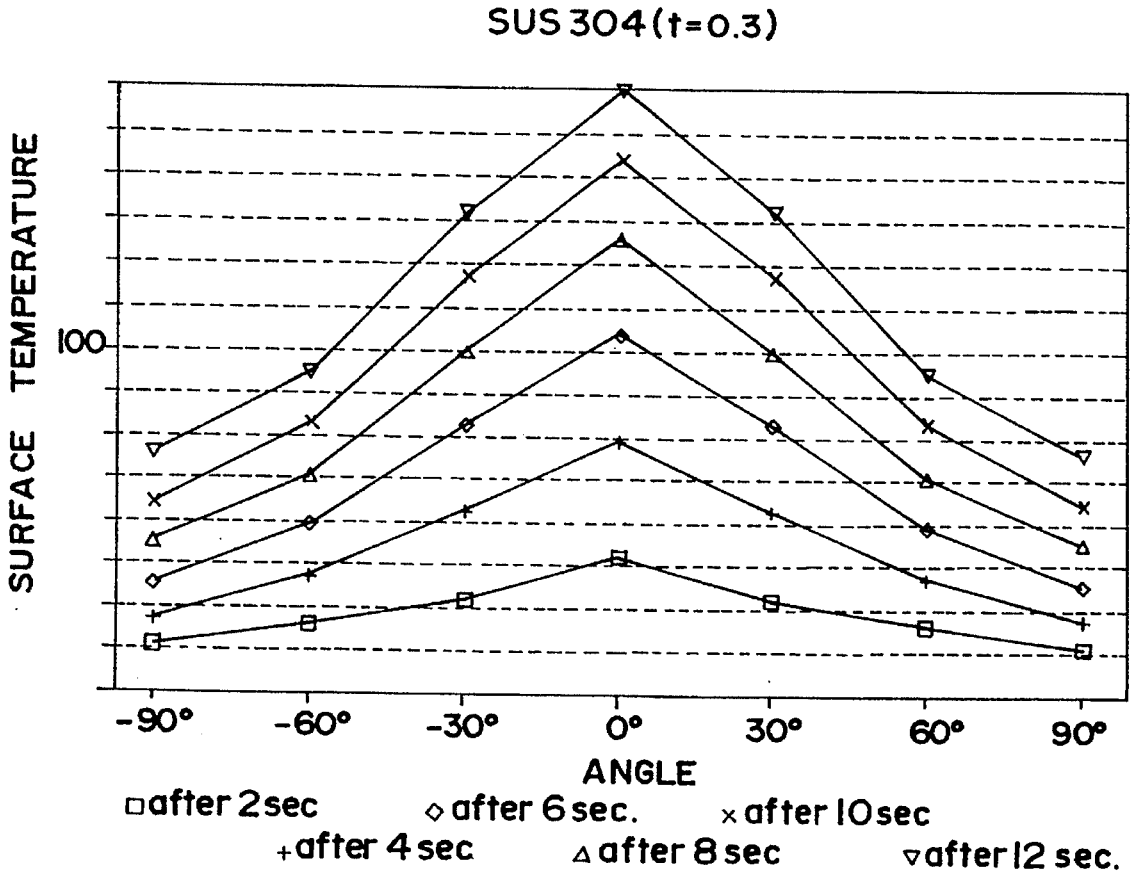
FIG. 9 is a graph showing the result obtained by measuring the surface temperature of another heat roller as used in the fixing device.

When the control signal from the control circuit 16 becomes on, the drive circuit 21 first turns on a switching element 22 comprising, for example, a transistor, FET or IGBT, whereby the coils 9 are energized. On the other hand, a current detecting circuit 23 detects the current reaching a specified value IP, whereupon the circuit feeds a signal to the drive circuit 21 to turn off the switching element 22. FIG. 5(*a*) shows the waveform of the current I detected by the current detecting circuit 23. When the element 22 is turned off, a resonance current passes between a resonance capacitor 24 and the coils 9. While the voltage V on the coil (9) side of the switching element 22 then drops nearly to 0 V, a voltage detecting circuit 25 detects this voltage drop, whereupon the circuit feeds a signal to the drive circuit 21 to turn on the switching element 22 again. The high-frequency current is passed through the coils 9 by subsequently repeating this switching cycle. The waveform of the voltage V to be detected by the voltage detecting circuit 25 is shown in FIG. 5(*b*), and the on/off signal of the switching element 22 (e.g., gate on/off signal for FET) in FIG. 5(*c*).

Figure 10:
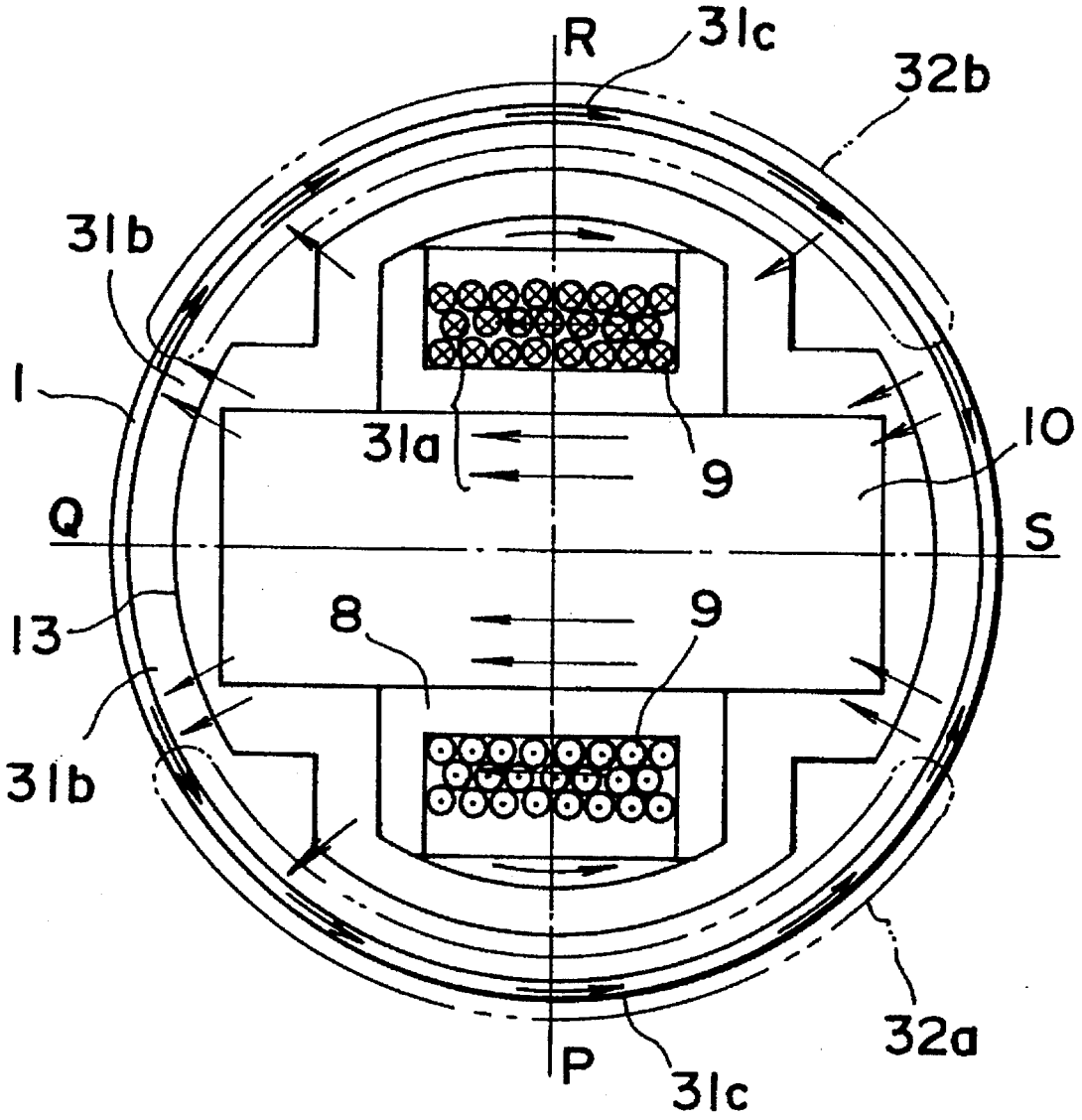
FIG. 10 is a diagram for illustrating the heating principle of the induction heating fixing device embodying the invention.

FIGS. 6 to 9 are graphs showing the results obtained by measuring the surface temperature of heat rollers 1 of different materials when a current of several kHz to several tens of kHz was passed through the coils 9 in the fixing device of the present embodiment. The materials used for the heat rollers 1 in the experiments were iron, SUS430, nickel and SUS304 and were all 0.3 mm in wall thickness. In the graphs, plotted as abscissa is the angle when the roller portion P opposed to the coils 9 is taken as 0 degree as shown in FIG. 10, and as ordinate the surface temperature. Each of these graphs reveals that the surface temperature of the heat roller 1 was highest at the portion P (0 degree) and decreased from position to position away from this portion. The highest temperature was available locally when SUS304 was used as the material. Since the heat roller of the present embodiment is shaped symmetrically with respect to an axis in cross section, the roller has a portion R of the same heating characteristics as the portion P at the position symmetric therewith.

The fact that the portions P, R of the heat roller 1 opposed to the coil 9 are higher in temperature than the other portion is thought attributable to the following reason. The current of high frequency (several kHz-several tens of kHz), when passed through the coil 9, produces magnetic flux 31*a* orthogonal to the longitudinal axis of the heat roller 1 as shown in FIG. 10 according to "the right-hand screw rule." The flux 31*a* is also a high-frequency flux. Magnetic flux 31*b* reaching the heat roller 1 which is a conductor bends along the roller 1 and becomes, at a ratio dependent on the specific magnetic permeability of the conductor, magnetic flux 31*c* passing inside the circumferential face of the heat roller 1. The flux 31*c* concentrating on the circumferential wall of the roller 1 has the greatest density at the portion opposed to the coil 9.

The concentrating magnetic flux 31*c* acts to produce in the interior of the wall of the heat roller 1 an eddy induction current which opposes the flux 31*c* and produces magnetic flux opposite to the flux 31*c* in direction according to "Lenz's law." The induction current is converted to Joule heat by virtue of the surface-layer resistance of the heat roller 1, causing the roller to give off heat. Thus, it is thought that the magnetic flux 31*c* concentrates along the wall of the heat roller 1, giving a maximum flux density to the portions P, R, which are therefore heated up to a higher temperature than the other roller portion.

According to the embodiment described above, the coil assembly 3 is so positioned that the coil 9 is centered about an axis orthogonal to the axis of rotation of the heat roller 1, whereby the specified peripheral portion of the heat roller 1 can be made to generate heat locally without increasing the supply of current. Moreover, the local heat generating portion P is made to correspond to the nip where the heat roller 1 is in contact with the pressure roller 2 to ensure heating with improved thermal efficiency. The arrangement wherein the plurality of coil assemblies 3 of the same size are aligned along the axis of rotation is easier to fabricate than a single coil assembly which is elongated along the axis of rotation, and further assures a uniform temperature distribution over the surface of the heat roller 1 axially thereof.

With the foregoing embodiment, the thermistor 6 for detecting the surface temperature of the heat roller 1 and the thermostat 15 for breaking the circuit upon the surface temperature of the heat roller 1 reaching the predetermined abnormal level are arranged in contact with the local heat generating portion R mentioned.

Because the heat generating portions P and R have the same heating characteristics and further because the temperature of the portion P is difficult to directly detect owing to the presence of the pressure roller 1, the thermistor 6 is so located to detect the temperature of the portion R instead of the portion P, to control the temperature of the local heat generating poriton P in contact with the pressure roller 1 to an appropriate fixing temperature range, to thereby ensure satisfactory fixing and to preclude high-temperature offset. Likewise, the thermostat 15 is so located as stated above because of the necessity of detecting the temperature of the portion R having the same heating characteristics as the portion P which heats the sheet to the highest temperature, in order to reliably obviate smoking or ignition of sheets owing to an abnormal rise in the temperature of the heat roller 1.

Stated conversely, the foregoing arrangement can be realized because the coil 9 is provided around the axis orthogonal to the axis of rotation of the heat roller 1 to enable the roller 1 to effect local heating equivalently at the two circumferential portions thereof.

Another induction heating fixing device of the invention, i.e., a second embodiment thereof, will be described next with reference to the drawings concerned.

Figure 11:
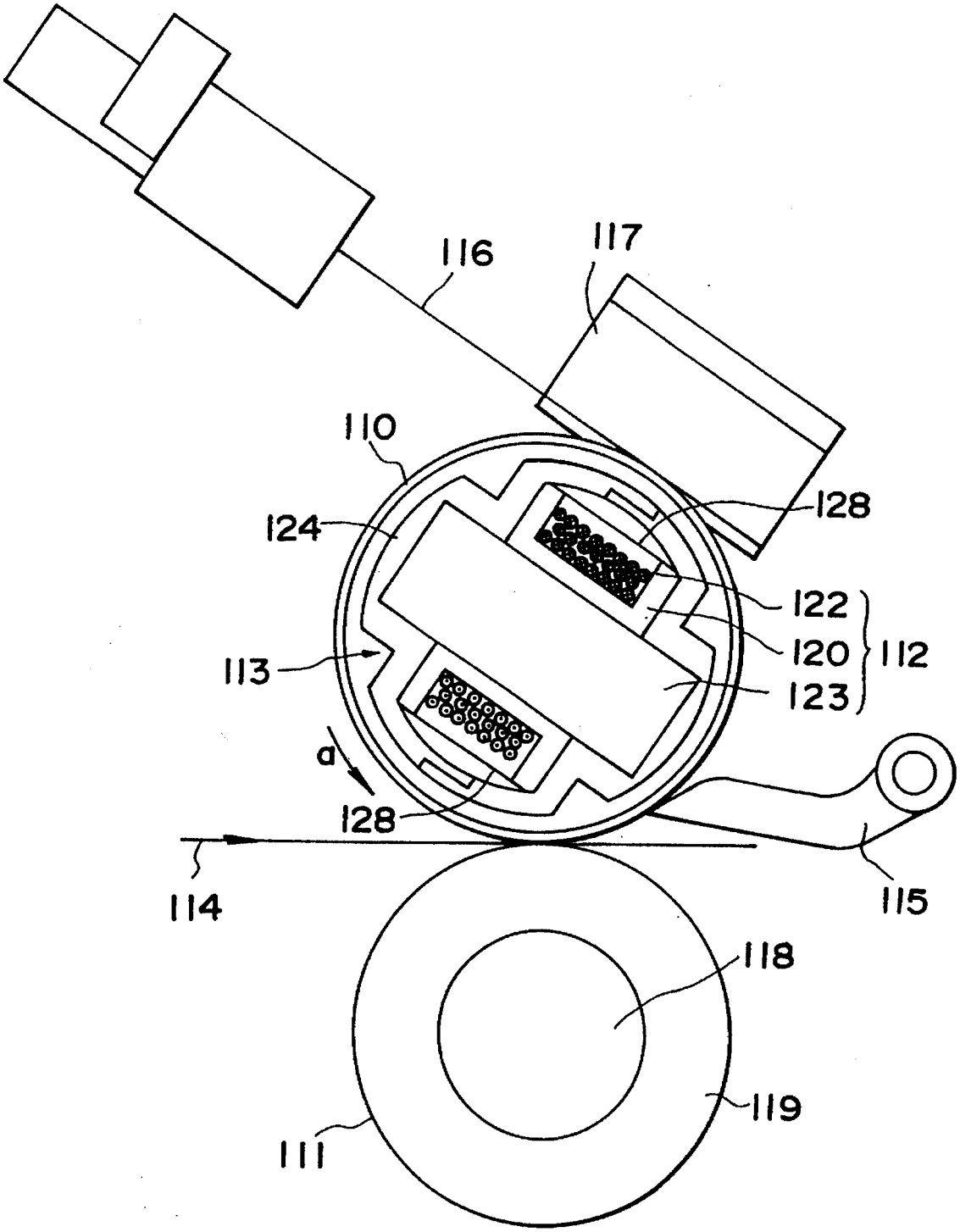
FIG. 11 is a sectional view showing another induction heating fixing device embodying the invention, i.e., a second embodiment.
Figure 13:
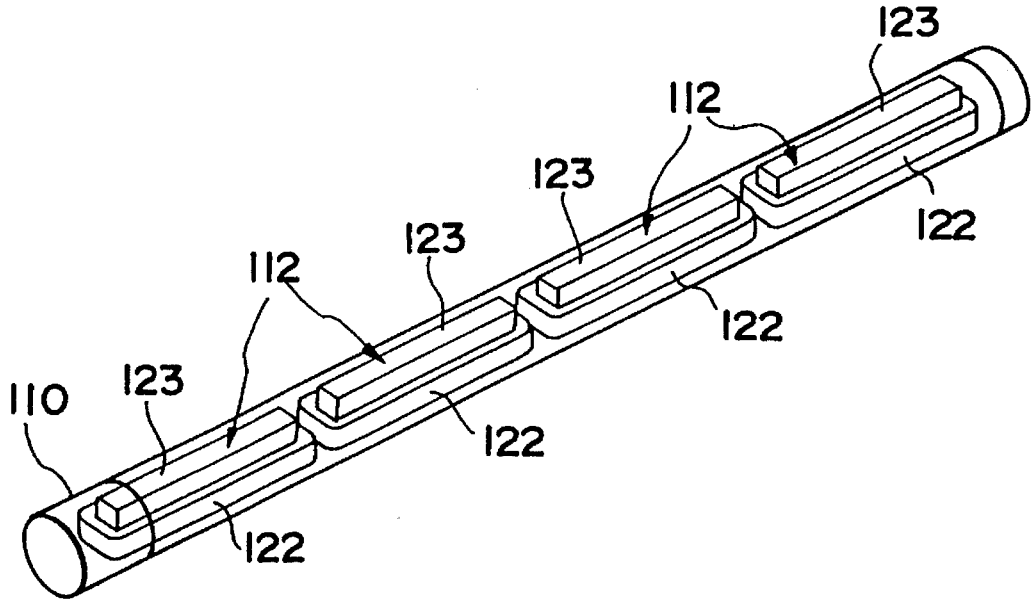
FIG. 13 is a perspective showing coils and cores within the heat roller shown in FIG. 11.

With reference to FIG. 11, the fixing device, which is incorporated in a printer or the like, has a heat roller 110 drivingly rotatable in the direction of arrow a, and a pressure roller 111 disposed in pressing contact with the heat roller 110 and rotatable by the rotation of the roller 110. As shown in FIG. 13, the heat roller 110 is a hollow pipe of conductor, and a plurality of coil assemblies 112 are arranged inside the roller along the axis of rotation (axis of the pipe) for generating an induction current in the heat roller 110. Especially according to the present embodiment, the coil assemblies 112 are so arranged that each two adjacent coil assemblies 112 produce flux in opposite directions. The coil assemblies 112 are held by a holder 124, constituting a holder unit 113.

Figure 12:
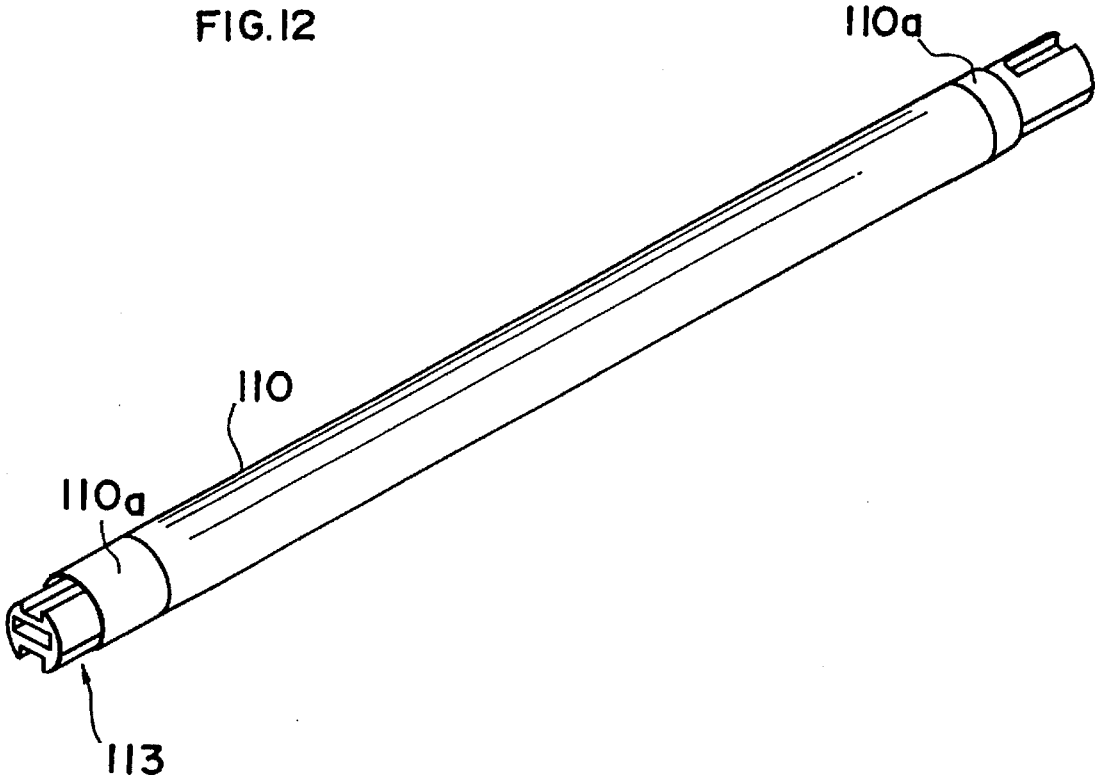
FIG. 12 is a perspective view showing a heat roller shown in FIG. 11.

With reference to FIG. 12, the heat roller 110 has a slide bearing portion 110*a* at each of its opposite ends and is rotatably mounted on an unillustrated fixing unit frame. The roller 110 further has an unillustrated drive gear fixed to one end thereof and is drivingly rotated by an unillustrated drive source such as a motor coupled to the drive gear. The holder unit 113 is housed in the heat roller 110 with a minimized clearance of specified dimension provided around the unit inside the roller 110. The holder unit 113 is secured to the fixing unit frame and held out of rotation.

A sheet 114 bearing an unfixed toner image transferred thereto is forwarded from the left-hand side of FIG. 11 and fed to the nip of the heat roller 110 and the pressure roller 111. The sheet 114 is passed through the nip while being subjected to the heat of the roller 110 heated on the foregoing principle and to the pressure exerted thereon by the two rollers 110, 111, whereby the toner is fixed to form a fixed toner image on the sheet 114. Upon passage through the nip, the sheet 114 spontaneously separates from the heat roller 110, or is forced to separate from the roller 110 by a separating claw or guide 115 having a forward end in sliding contact with the surface of the heat roller 110 as seen in FIG. 11. The sheet is sent rightward in FIG. 11. The sheet 114 is transported by an unillustrated discharge roller and delivered onto a discharge tray.

A thermistor 116 is disposed above the heat roller 110 to serve as a temperature sensor for detecting the temperature of the heat roller 110. The thermistor 116 is pressed against the surface of the roller 110 so as to be opposed to a side of a coil 122 with the wall of the roller 110 interposed therebetween. With the thermistor 116 acting to detect the temperature of the heat roller 110, the current to be passed through the coils 122 is so controlled as to heat the heat roller 110 to an optimum temperature.

Further provided on the heat roller 110 is a thermostat 117 serving as safety means in an event of an abnormal rise in temperature. The thermostat 117, which is in pressing contact with the surface of the heat roller 110, opens a contact when a predetermined temperature is reached to cut off the supply of current to the coils 122, whereby the heat roller 110 is prevented from becoming heated to a temperature higher than the predetermined level.

The heat roller 110 is formed by an electrically conductive member such as a carbon steel pipe, stainless alloy pipe or aluminum alloy pipe, coated with a fluorocarbon resin over the outer periphery thereof and thereby formed with a heat-resistant release layer over the surface. It is more preferable that the heat roller 110 be formed by a conductive magnetic member. The pressure roller 111 comprises an axial core 118, and a heat-resistant rubber layer having a surface of release properties, i.e., silicone rubber layer 119, formed around the core. The slide bearing portions 110*a* and the separating claw 115 are made of a heat-resistant slidable engineering plastic or the like.

As in the case of the first embodiment, the coil assembly 112 comprises a rectangular bobbin 120 having a central opening 120*a*, and the above-mentioned coil 122 formed by winding a copper wire around the bobbin quasi-regularly in successive turns (to dispense with end treatment and connection). The bobbin 120 has inserted in its opening 120*a* a core 123 orthogonal to the copper wire of the coil 122. The bobbin 120 may be made, for example, of a ceramic or heat-resistant insulating engineering plastic. Preferably the coil is prepared from a single-component or litz copper wire having a fusion layer and insulating layer over the surface. The core 123 comprises, for example, a ferrite core or core of superposed layers.

With reference to FIG. 13, the coil assembly 112 is so positioned that the turns of the copper wire wound around the bobbin 120 extend along a plane parallel to the axis of rotation of the heat roller 110, with the core 123 oriented orthogonally to the axis, so as to produce magnetic flux in a direction orthogonal to the axis.

Figure 14:
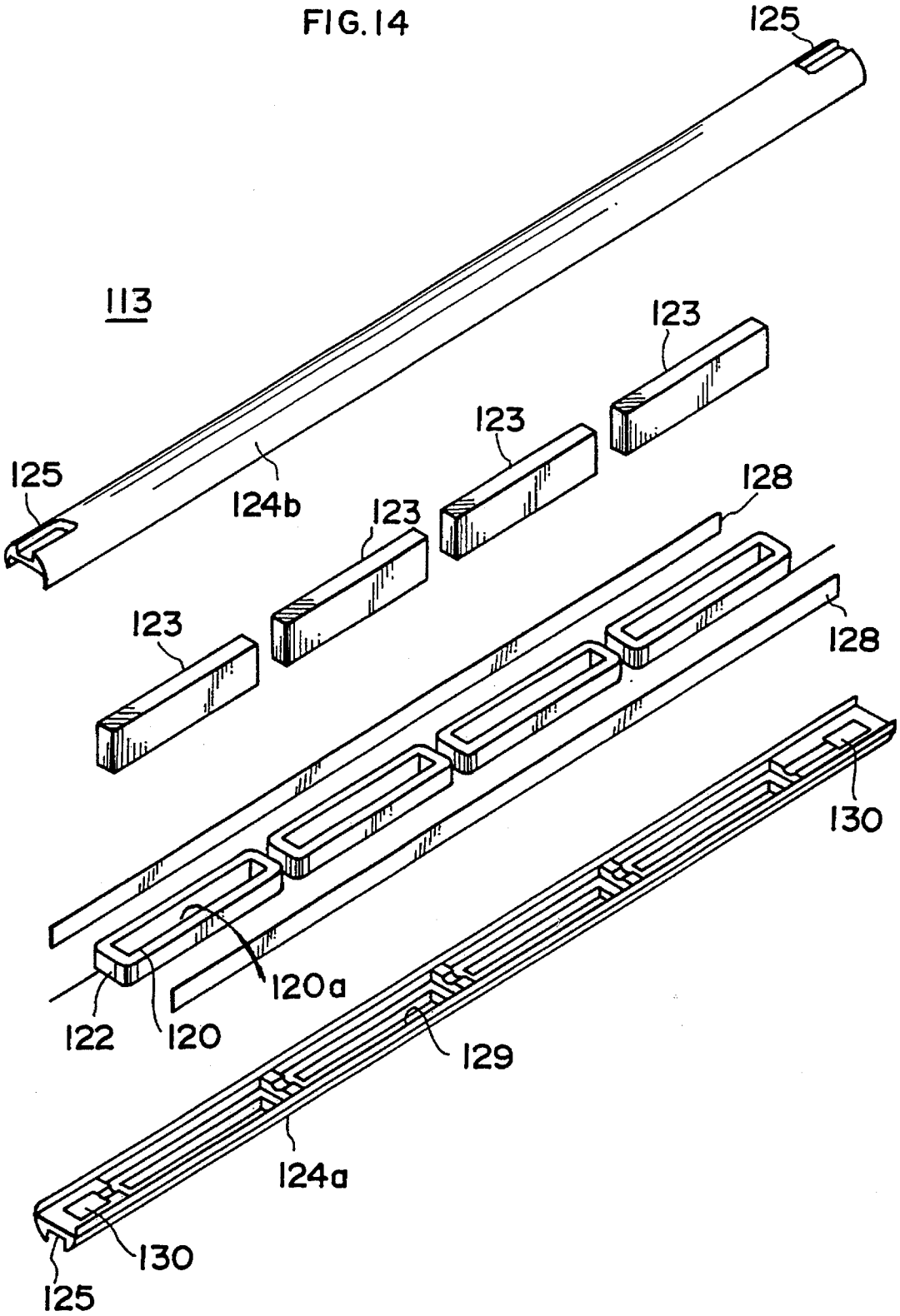
FIG. 14 is an exploded perspective view showing the interior construction of a holder unit.

Further according to the present embodiment as shown in FIGS. 11, 13 and 14, the plurality of coil assemblies 112 are aligned axially of the heat roller 110 so that the cores 123 are nearly parallel to the direction of transport of the sheet 114 with the coils 122 substantially opposed to the pressure roller 111. Stated precisely, the coil assemblies 112 are so arranged that the coils 122 are positioned slightly upstream from the nip of the heat and pressure rollers 110, 111, in view of the movement of the heated-up roller surface portion with the rotation of the heat roller 110. Each coil 122 is covered with an insulating film 128 over its outer periphery. The film 128 is made of a heat-resistant insulating resin such as polyimide or polyphenylene sulfide. The holder 124 comprises a holder stay 124*a* and a holder cover 124*b* fitted to the holder stay 124*a*. These components are each made of a heat-resistant insulating engineering plastic. With reference to FIG. 14, the holder stay 124*a* and the holder cover 124*b* are internally formed with recesses 129 for holding the coil assemblies 112 and have a fitting portion 125 at each of their opposite ends for fixing the holder unit 113 to the fixing unit frame. The holder unit 113 is assembled, for example, by inserting the coils 122 into the respective recesses 129 formed in the holder stay 124*a*, inserting the cores 123 each through the opening 120*a* of each bobbin 120, providing the insulating film 128 around each coil 122 and attaching the holder cover 124*b* to the holder stay 124*a*. The coils 122 are connected together in series inside the holder 124. Connector terminals 130 having connected thereto the respective terminals of the combination of coils 122 are provided on opposite ends (or one end) of the holder unit 113. Via the terminals 130, the coils are connected to the high-frequency power source 135 to be described below for supplying a high-frequency current. The holder unit 113 has an outside diameter slightly smaller than the inside diameter of the heat roller 110 so as to provide a clearance around the unit 113 inside the roller 110. The heating principle of the heat roller 110 of the present embodiment is the same as that already described with reference to FIG. 10 and therefore will not be described.

With the device described, the magnetic flux density in the circumferential surface of the heat roller 110 is maximum at the two points of the roller 110 opposed to the opposite sides of the coil 122, that is, at points P, R in FIG. 10 (which is now referred to for the illustration of the present case), and is conversely minimum at points Q, S. Accordingly, since the induction current density also exhibits a similar tendency, heat generation in the circumferential surface of the heat roller 110 is not uniform but occurs locally at portions 32*a*, 32*b* which are surrounded by a broken line in FIG. 10.

These portions where heat generation occurs locally correspond to an upper region and lower region of the heat roller 110 when indicated in FIG. 11. One of the heat generating portions (regions) therefore at least laps over the nip. The thermistor 116 is in contact with the other heat generating portion (region), and the thermostat 117 is also in contact with or in proximity to this portion. The thermistor 116 may be provided at an upper or lower portion of the heat roller 110, while it is disposed at the upper portion outside the roller 110 in the illustrated embodiment. The thermistor 116, if small, may be provided inside the upper or lower portion of the heat roller 110.

Figure 15:
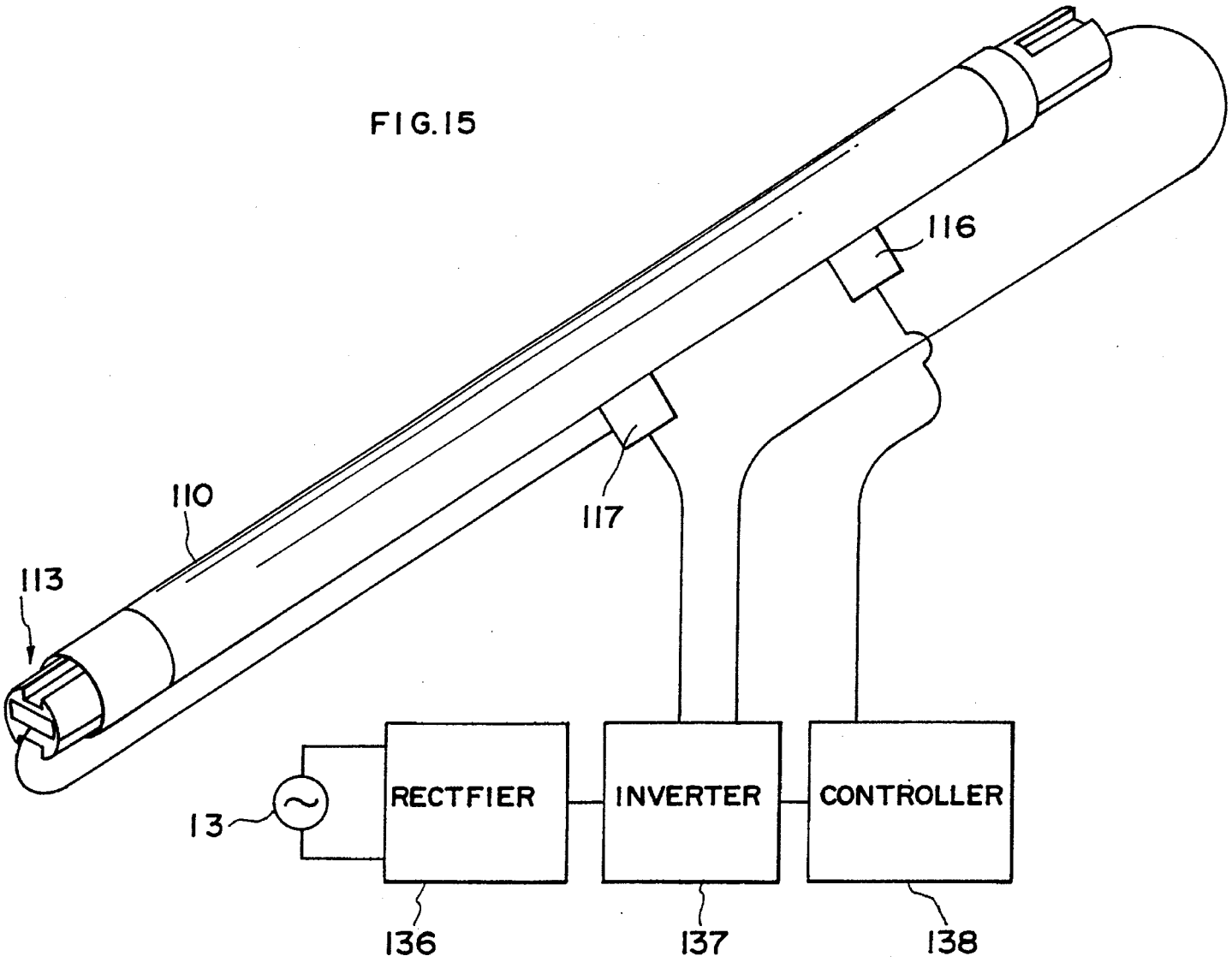
FIG. 15 is a perspective view showing a coil assembly included in the second embodiment.

FIG. 15 is a block diagram of a circuit for passing a high-frequency current through the induction heating coils 122 and controlling the temperature of the heat roller 110.

The high-frequency current is produced by rectifying the alternating current of a commercial power source 13 by a recitifier circuit 136 and converting the current by a self-excited inverter circuit 137. The current is supplied to the coils 122 via the thermostat 117 which is in pressing contact with the surface of the heat roller 110, and the current path is broken by the thermostat 117 upon the surface temperature of the heat roller 110 reaching a predetermined abnormal level. The rectifier circuit 136, inverter circuit 137 and control circuit 138 are the same as those of the first embodiment and therefore will not be described again.

The arrangement of coils 122 will be described next.

Figure 17A:
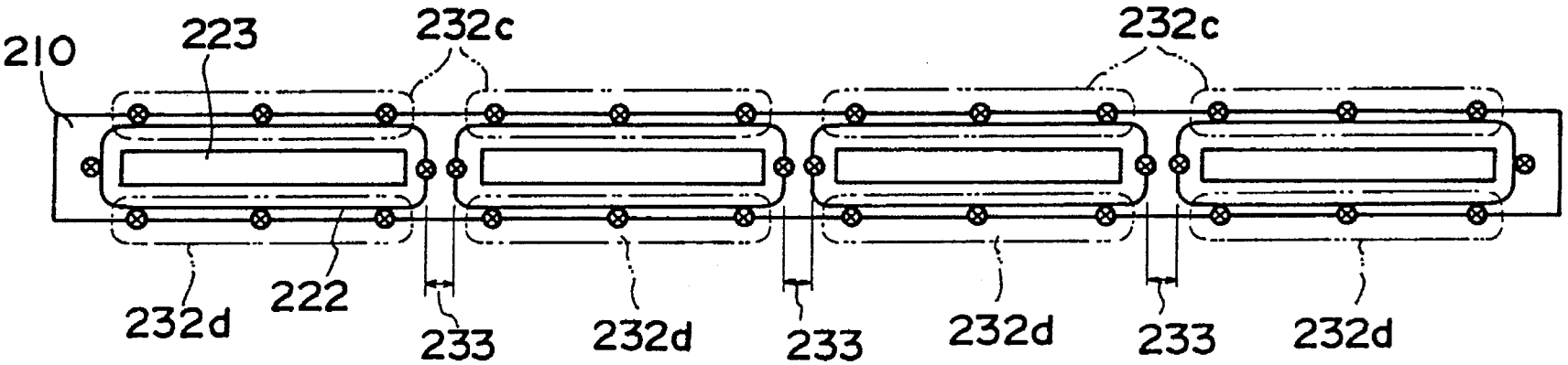
FIGS. 17(A) and (B) correspond respectively to a plan view and side elevation of FIG. 16 and are diagrams for illustrating generation of magnetic flux and heat generating regions of a heat roller in the reference example shown in FIG. 16.
Figure 17B:
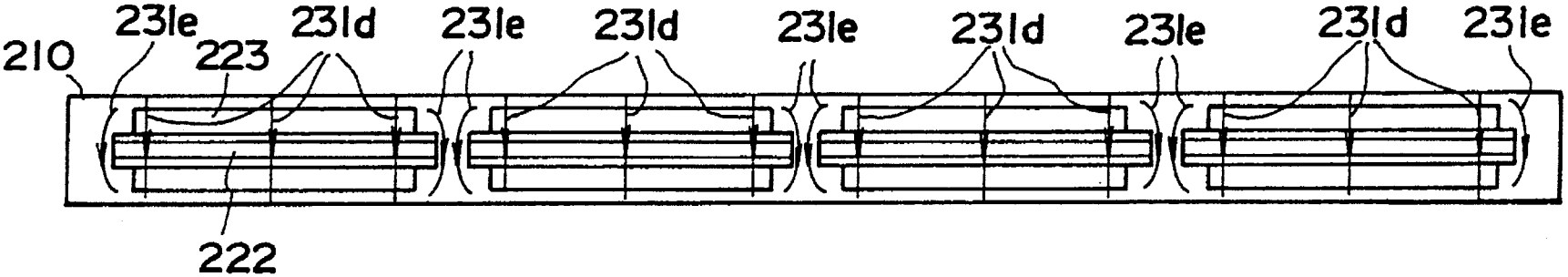

First, an arrangement of reference example will be described with reference to FIGS. 16 to 18 before describing the arrangement of the present embodiment. In the reference example which is shown in FIG. 16 and FIGS. 17(A) and (B), a plurality of coils 222 for producing an induction current in a heat roller 210 of conductor are so arranged or connected that the magnetic fluxes to be produced by all coils are identical in direction. These fluxes are indicated at 231*d* and 231*e* in FIG. 17(B). The fluxes 231*d* are the same as the flux 31*a* shown in the heating principle diagram of FIG. 10 and are eventually related to the heat generation of the heat roller 210, providing heat generating portions or regions 232*c*, 232*d*. On the other hand, the magnetic fluxes 231*e* are almost unlikely to be positioned in the surface of the heat roller 210 as shown in FIG. 18 and accordingly contribute nothing to the heat generation of the heat roller 210. Further in the case where there is a coil gap portion 233 between the adjacent coils 222, the roller 210 has no heat generating region in the gap portion 233. Consequently, such coil gap portions 233, if great, give a nonuniform temperature distribution to the heat roller 210 along the direction of the axis of rotation, failing to assure the roller 210 of uniform fixing characteristics axially thereof to result in adversely affected fixing performance.

Figure 19:
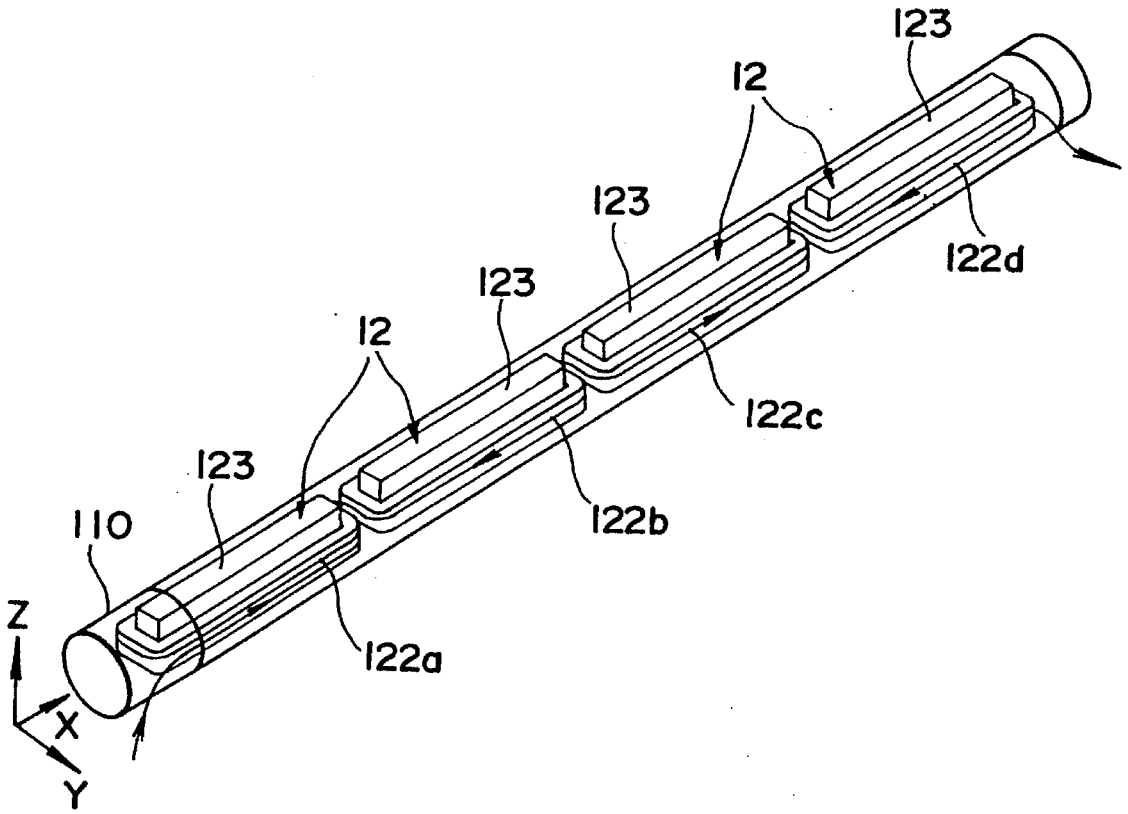
FIG. 19 is a perspective showing the arrangement of coils in the second embodiment.
Figure 20A:
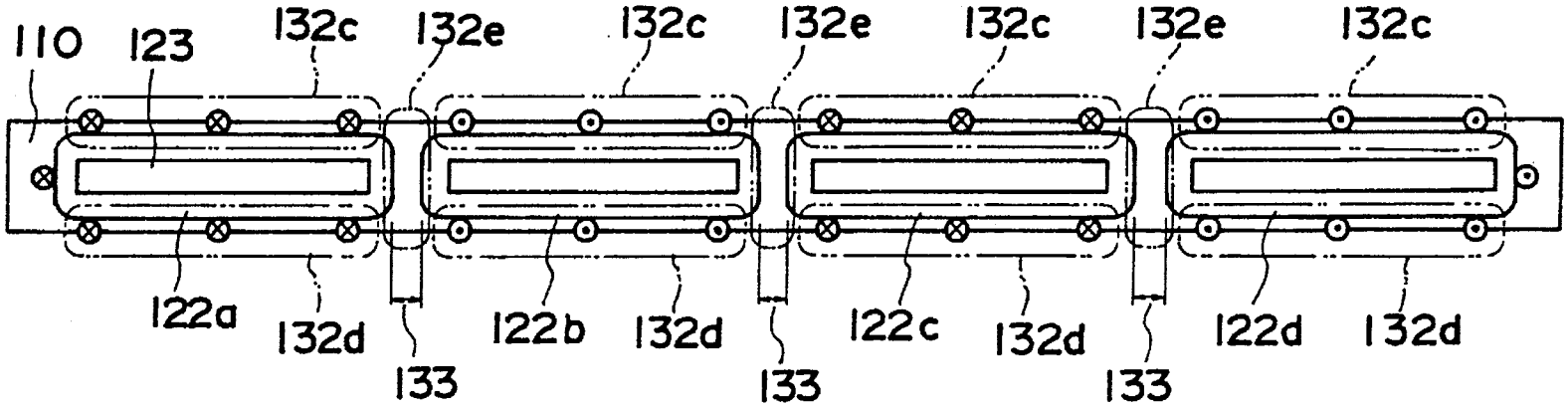
FIGS. 20(A) and (B) correspond respectively to a plan view and side elevation of FIG. 19 and are diagrams for illustrating generation of magnetic flux and heat generating regions of the heat roller in the second embodiment.
Figure 20B:
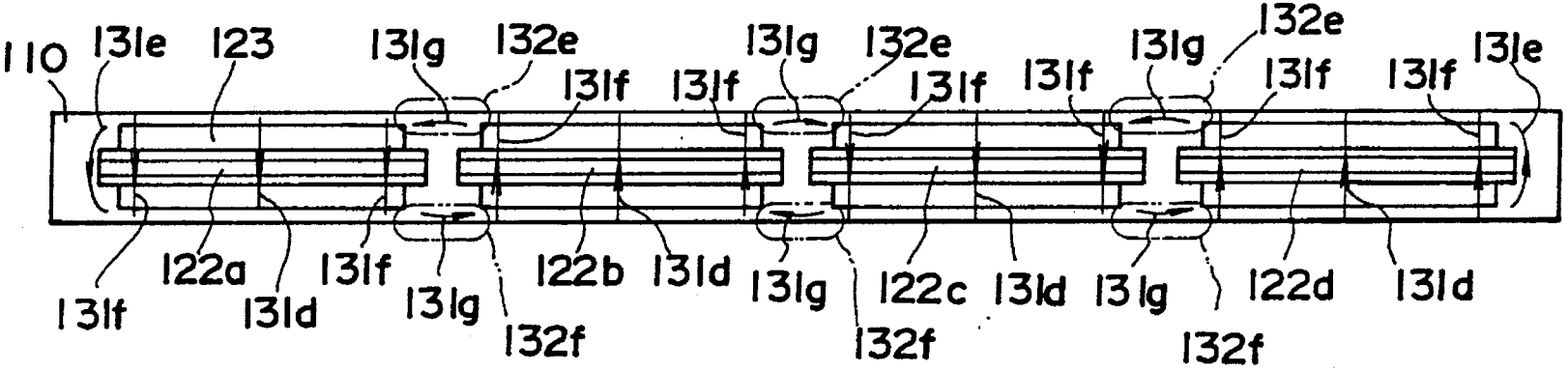
Figure 21:
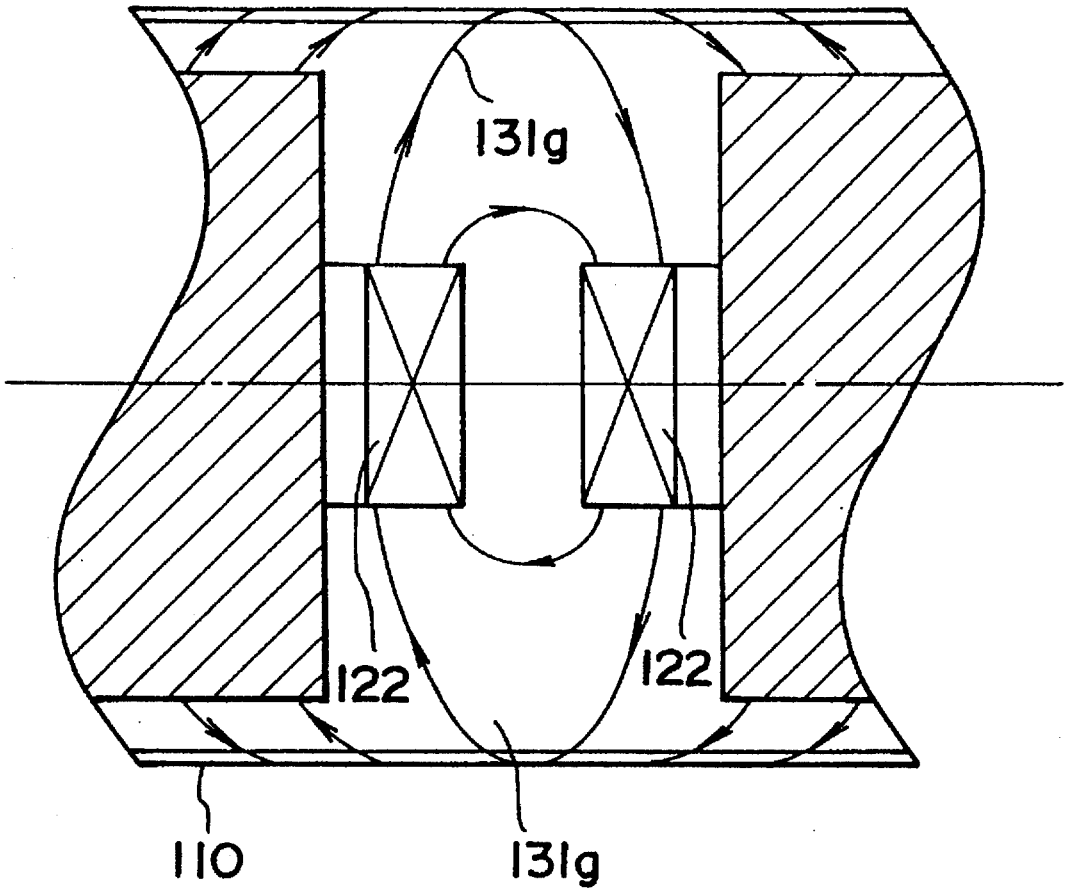
FIG. 21 is an enlarged diagram showing magnetic flux generated in an air gap portion of the second embodiment shown in FIG. 19.

Next, the arrangement in the present embodiment will be described with reference to FIGS. 19 to 21. As shown in FIG. 19 and FIGS. 20(A) and (B), the coils 122 of the embodiment are so arranged or connected that the coils 122*b*, 122*d* are opposite to the other coils 122*a*, 122*c* in the direction of magntic flux to be produced. The magnetic fluxes to be newly produced in this case are fluxes 131*f*, 131*g* as illustrated. The fluxes 131*g*, which are in accordance with "Coulomb's law," differ from flux 131*e* in the direction of magnetic flux and magnetic flux density. According to "Coulomb's law," N and S of a magnet attract, or N and N or S and S repel with a force inversely proportional to the square of the distance between the two magnetic poles. With respect to the direction of magnetic flux, the fluxes 131*g* are in-surface components in the direction of the axis of rotation of the heat roller 110 as seen in FIG. 21, so that new heat generating regions 132*e* and 132*f* occur in the heat roller 110. Further with the production of the magnetic fluxes 131*g*, magnetic fluxes 131*f* are generated which are higher than magnetic fluxes 131*d* in flux density.

Thus, the present embodiment is adapted to cause the adjacent coils 122 to produce magnetic fluxes which are opposite in direction, whereby unlike the case wherein the fluxes are in the same direction, the heat generating regions 132*e* and 132*f* are added to the heat roller 110 in the range of the coil gap portion 133.

Figure 22:
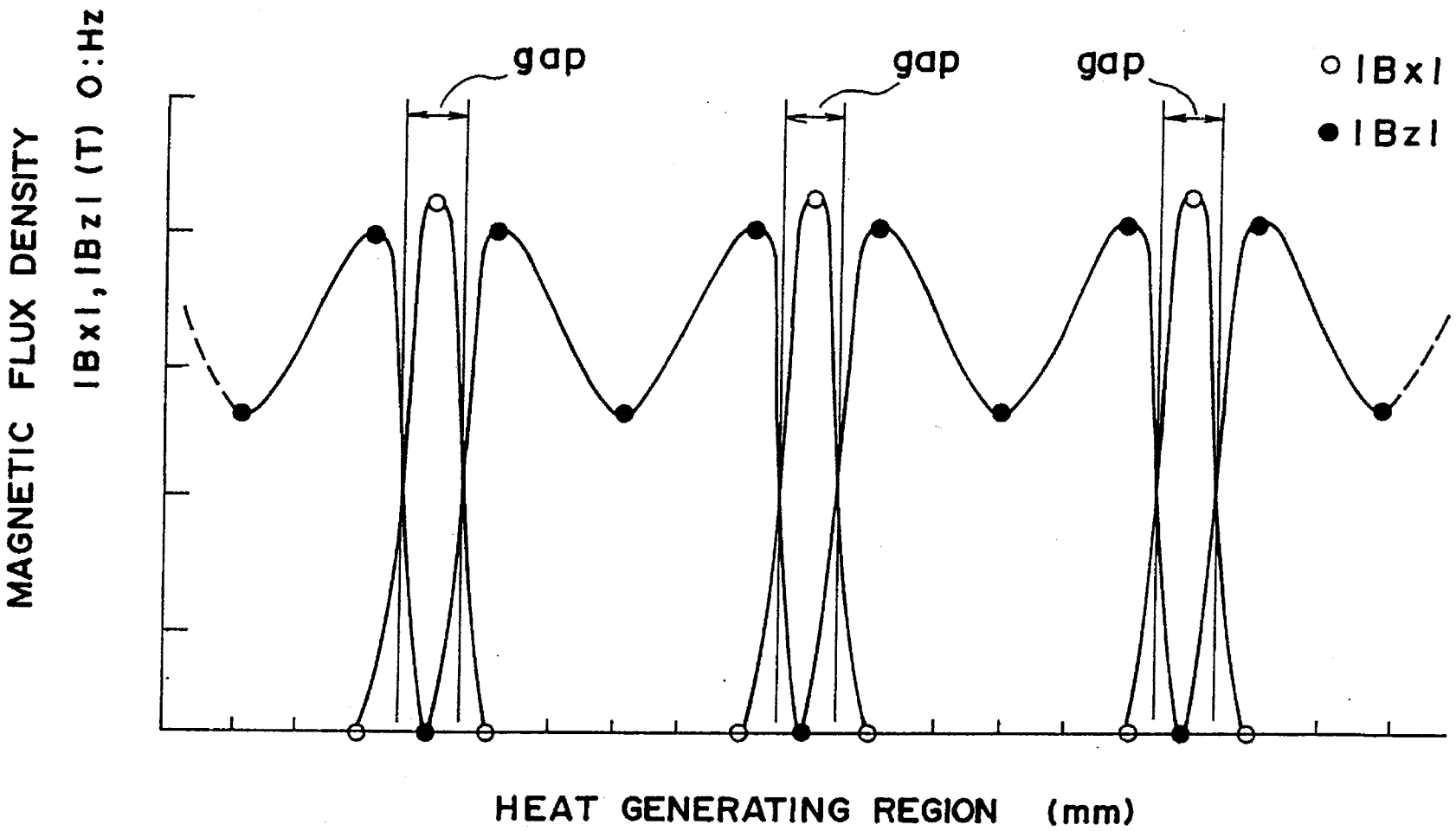
FIG. 22 is a graph showing the result obtained by measuring the magnetic flux density of the heat roller along the axis of rotation thereof.

FIG. 22 is a graph showing magnetic flux density measurements obtained along the axis of rotation of the heat roller 110. Plotted as abscissa is the position along the axis of the heat roller 110, and as ordinate are the maximum magnetic flux densities of the X- and Z-direction components at different positions along the axis of the heat roller 110. A direct current was supplied for the measurement. The X-, Y- and Z-axis directions are shown in FIG. 19.

The graph reveals that the arrangement of coils 122 according to the present embodiment produces magnetic flux as an X-axis direction component in the coil gap portion 133 formed between each two adjacent coils 122, and that the Z-axis direction component has a higher magnetic flux density in the vicinity of the gap portion 133 than at the midportion of the coil 122.

Figure 23:
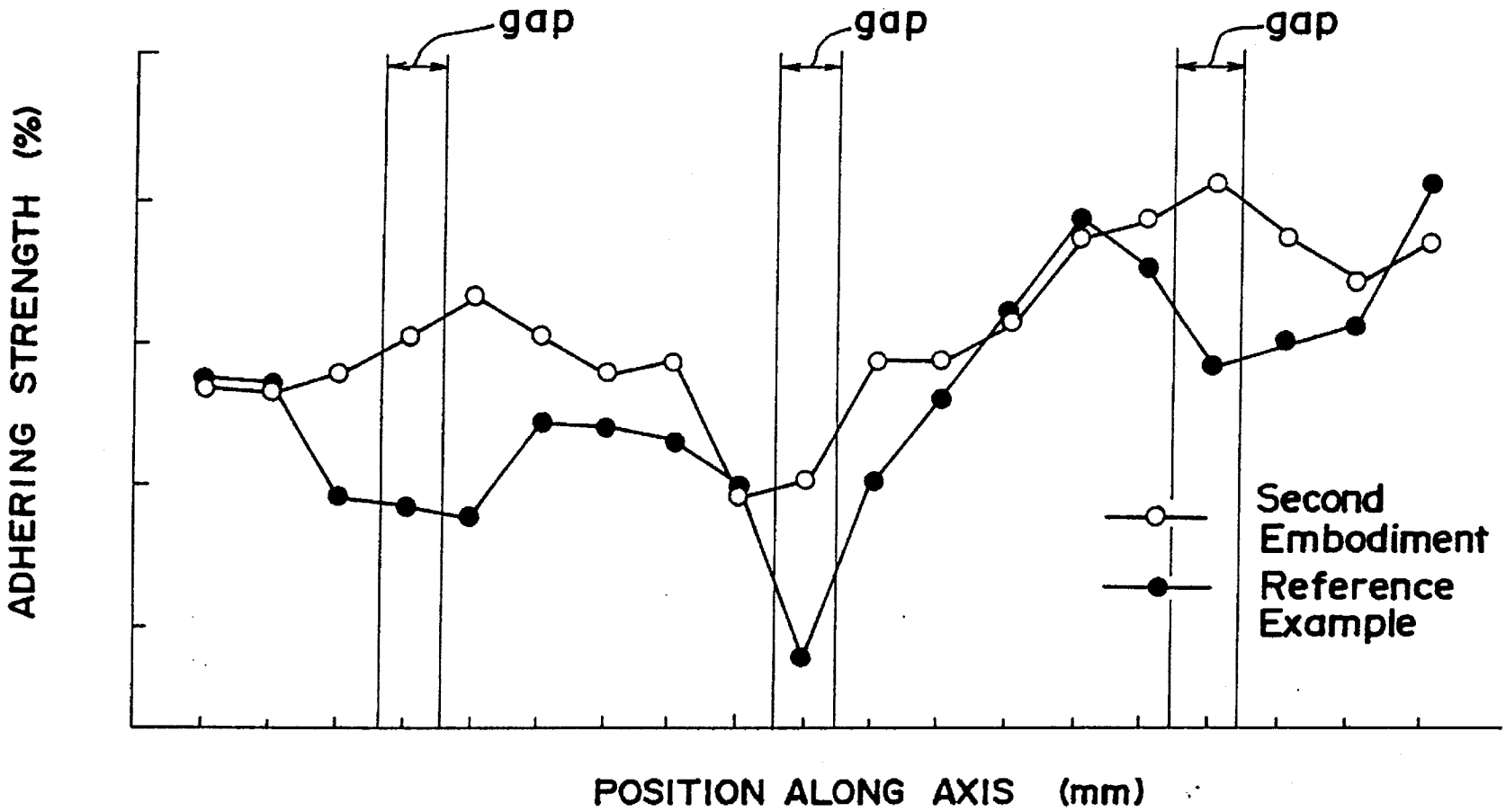
FIG. 23 is a graph showing measurements of fixing adhering strength obtained along the axis of rotation of the heat roller.

FIG. 23 shows fixing adhering strength measurements obtained along the axis of rotation of the heat roller 110. Plotted as abscissa in the graph is the image position in the direction of the axis of the heat roller 110 (main scanning direction), and as ordinate the fixing adhering strength measured for the second embodiment and the reference example at different positions along the axis of the heat roller 110.

The graph indicates that the arrangement of coils 122 according to the present embodiment gives fixed images improved strength against adhesion at the coil gap portions 133 and in the vicinity thereof, assuring the heat roller 110 of uniform fixing properties along the axis of rotation thereof.

According to the embodiment described above, the coil assembly 112 is positioned with its core 123 nearly in parallel to the direction of transport of the sheet, i.e., with its coil 122 centered about an axis orthogonal to the axis of rotation of the heat roller 110, whereby a specified peripheral portion of the heat roller 110 can be made to generate heat locally. Moreover, the local heat generating portion is made to correspond to the vicinity of the portion of the heat roller 110 in contact with the pressure roller 111 to thereby effect thermally efficient fixing. The arrangement wherein the coil assemblies 112 of the same size are aligned along the axis of rotation renders the coils easier to fabricate than when a single coil assembly which is elongated in the direction of the axis of rotation is used.

Further according to the present embodiment, the plurality of coils 122 are arranged inside the heat roller 110 so that the magnetic fluxes to be produced by each two adjcent coils 122 are opposite in direction. This simple construction produces new magnetic fluxes in accordance with "Coulomb's law," providing new heat generating portions or regions 132*e*, 132*f* in the heat roller 110 between the adjacent coils 122 and making it possible to give a uniform temperature distribution to the surface of the heat roller 110 axially thereof even if the coil gap portion 133 of considerable dimension is formed between the coils 122. The heat roller 110 can be consequently rendered uniform in fixing properties along the axis of rotation.

Additionally, the heat roller 110 can be made uniform in temperature distribution in the direction of axis of the roller even when the coil gap portions 133 are increased in width by decreasing the length of the coils 122 or cores 123. This makes it possible to achieve an improved induction heating efficiency at a reduced cost.

With the second embodiment described, the coils 122*b*, 122*d* only are arranged as reversed in direction among the coils 122*a* to 122*d* which are prepared by winding a copper wire in the same direction, whereas other method is usable insofar as the magnetic fluxes to be produced by each two adjacent coils 122 are opposite in direction.

The coil assembly 112 is not limited in configuration or structure to those of the foregoing embodiments, but the same advantages as those of the embodiments are available also when the assemly is modified variously.

Figure 24:
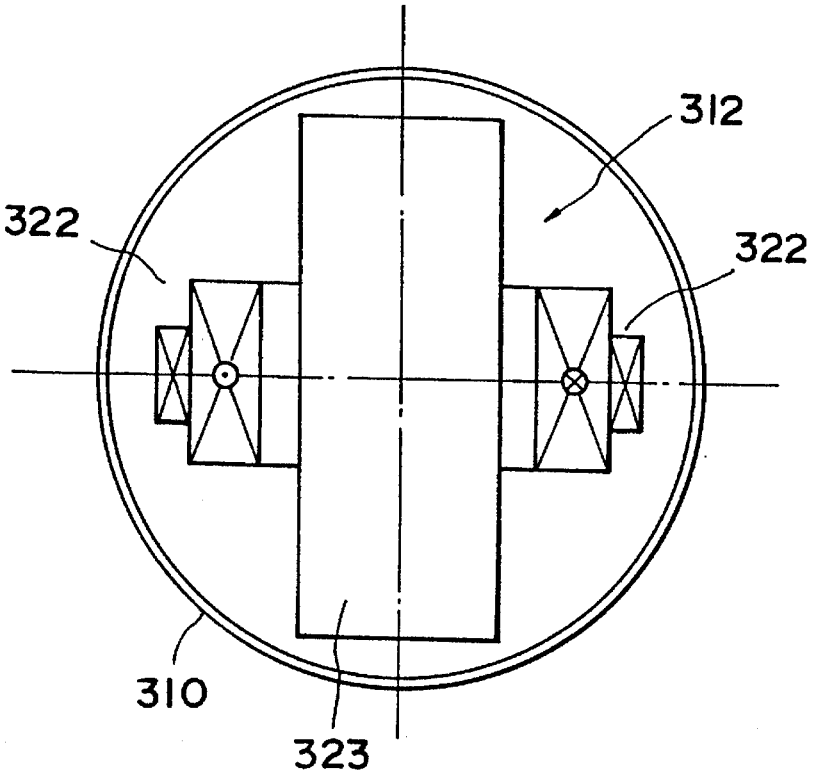
FIG. 24 is a fragmentary sectional view of a third embodiment of the invention comprising a coil assembly which includes a coil having a modified sectional shape.
Figure 25:
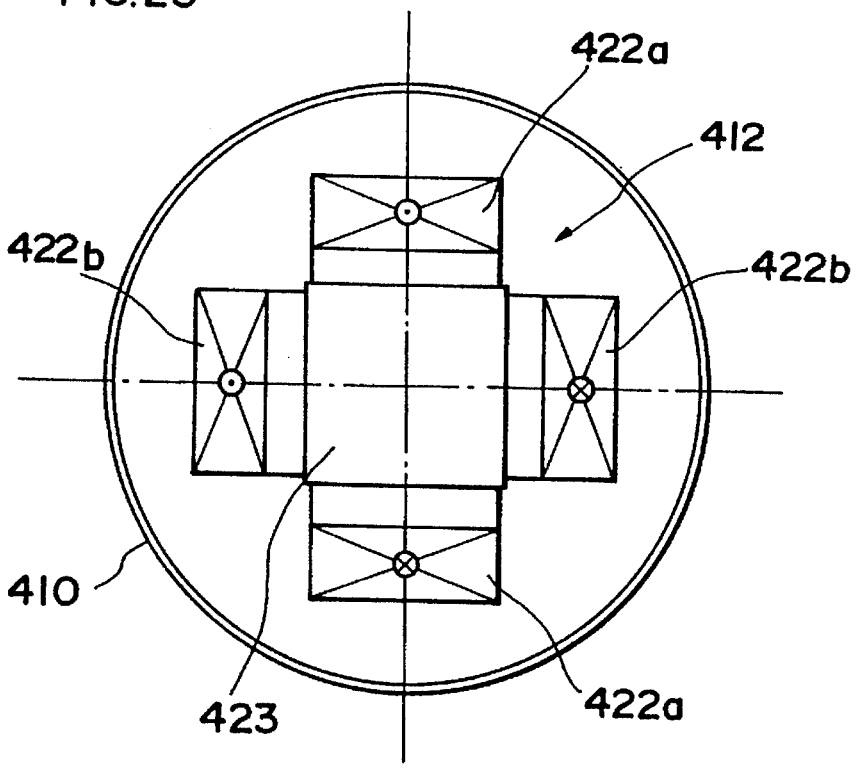
FIG. 25 is a fragmentary sectional view of a fourth embodiment of the invention comprising a coil assembly wherein the coils are in a modified arrangement in section.

FIGS. 24 and 25 are fragmentary sectional views showing third and fourth embodiments, respectively, wherein the coil assembly comprises a coil of modified sectional shape or coils in combination. It is desired that the coil for generating an induction current in the heat roller be positioned close to the roller wall over a wide area with a minimized gap formed therebetween so as to cause a flux of high density to act on the roller. The coil assembly 312 shown in FIG. 24 has a coil 322 wherein outer wire layers are smaller in the number of turns than inner wire layers and which has projections in overall section. The coil assembly 412 shown in FIG. 25 comprises two coils 422*a*, 422*b* having a usual cross sectional shape and combined together in the form of a cross in section.

Figure 26A:
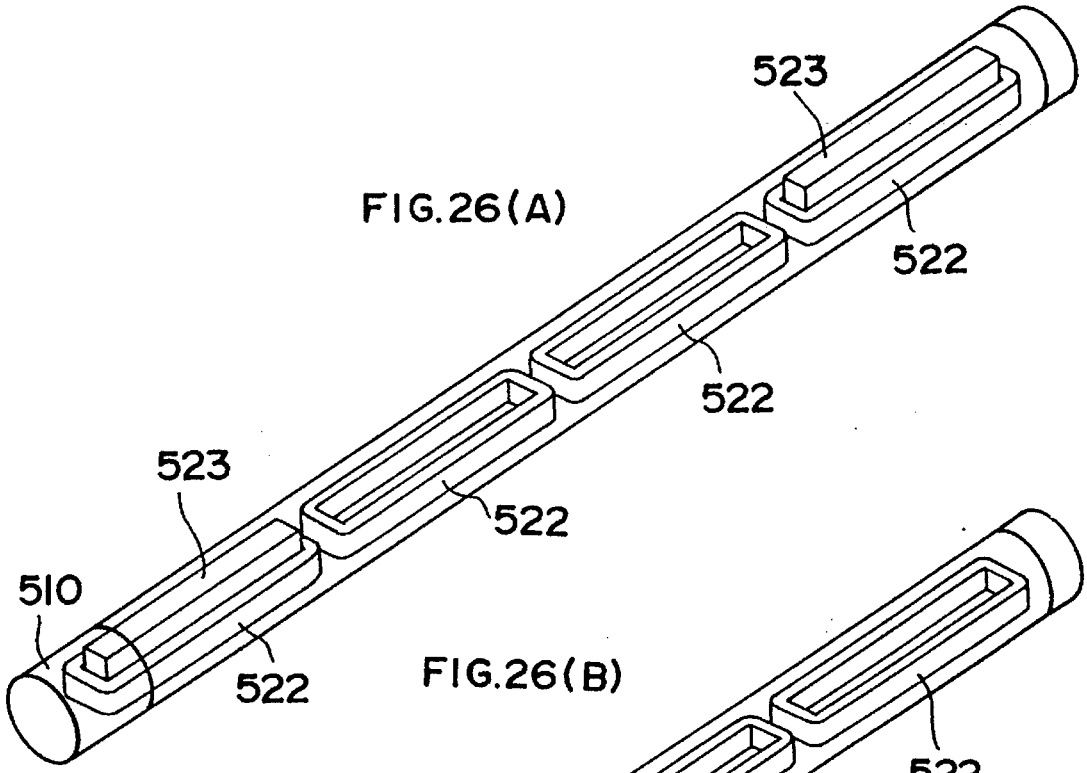
FIGS. 26(A) and (B) are perspective views of a fifth embodiment of the invention showing coil assemblies as modified to different coreless structures.
Figure 26B:
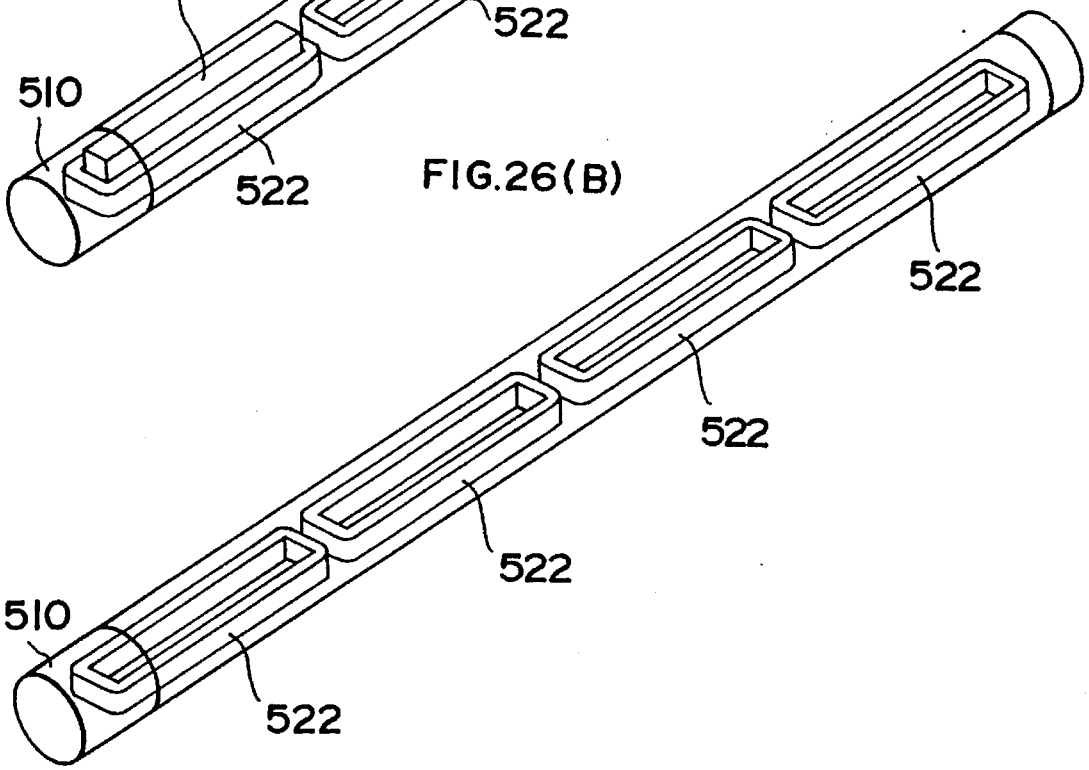

FIGS. 26(A) and (B) are perspective views showing coil assemblies as modified to different coreless structures according to a fifth embodiment. The core of the coil for inducing a current in the heat roller is used to increase the density of the magnetic flux to be produced by the coil and to form a magnetic path for guiding the flux to the heat roller. Although the coils all have a core with the foregoing embodiments, FIG. 26(A) shows that the coils 522 at opposite ends only are provided with a core 523 with the other coils 522 made coreless. Alternatively, all the cores 522 may be coreless as seen in FIG. 26(B).

FIGS. 27 to 31 are fragmentary sectional views of embodiments which are modified in the sectional configuration of the core of the coil assembly.

Figure 27:
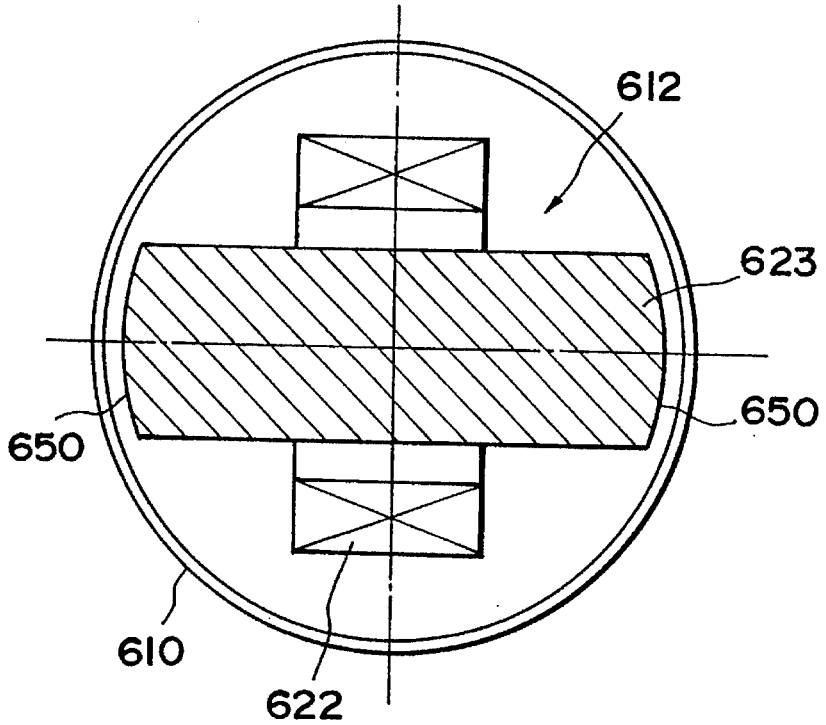
FIG. 27 is a fragmentary sectional view of another embodiment comprising a coil assembly wherein the core has a modified shape in section.
Figure 28:
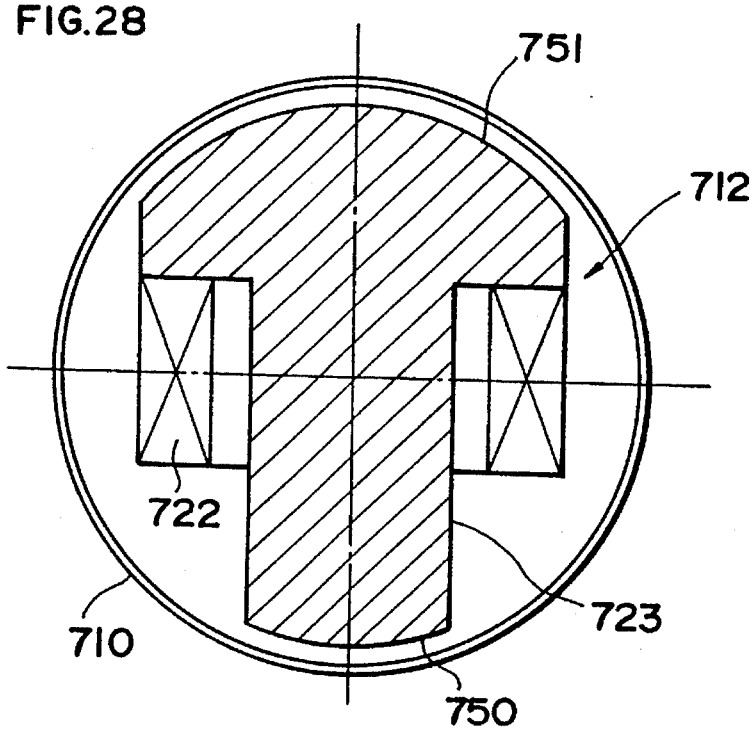
FIG. 28 is a fragmentary sectional view of another embodiment comprising a coil assembly wherein the core has a modified shape in section.
Figure 29:
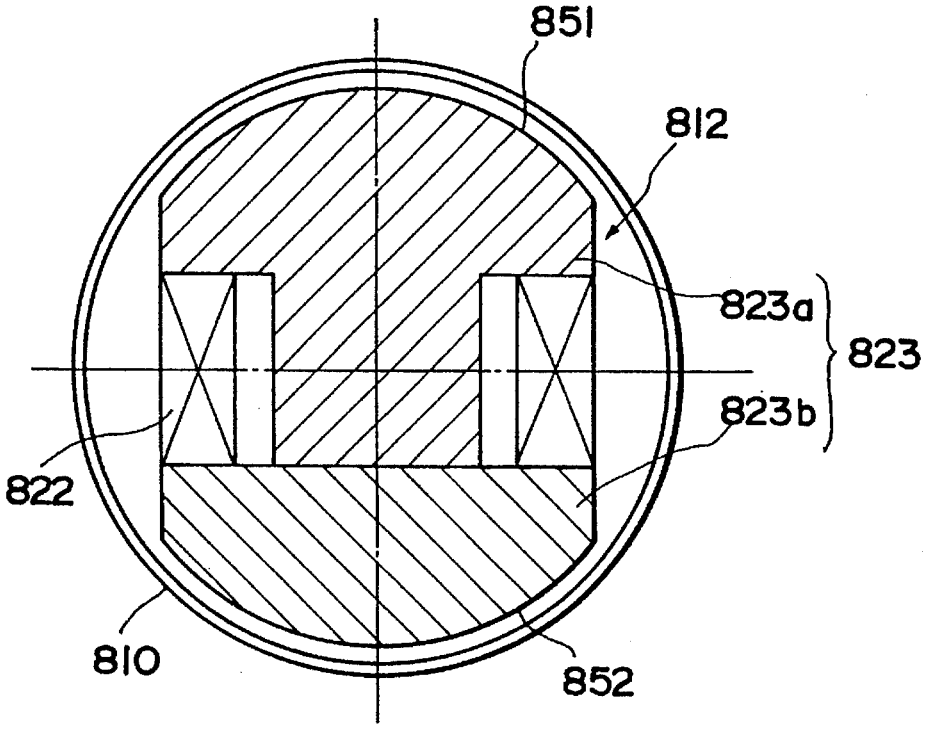
FIG. 29 is a fragmentary sectional view of another embodiment comprising a coil assembly wherein the core has a modified shape in section.
Figure 30:
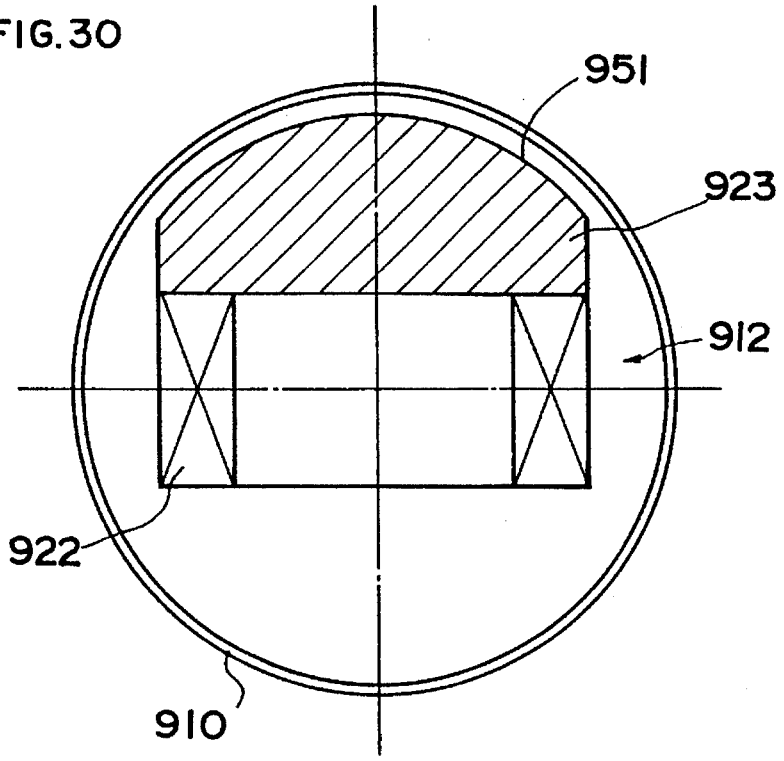
FIG. 30 is a fragmentary sectional view of another embodiment comprising a coil assembly wherein the core has a modified shape in section.
Figure 31:
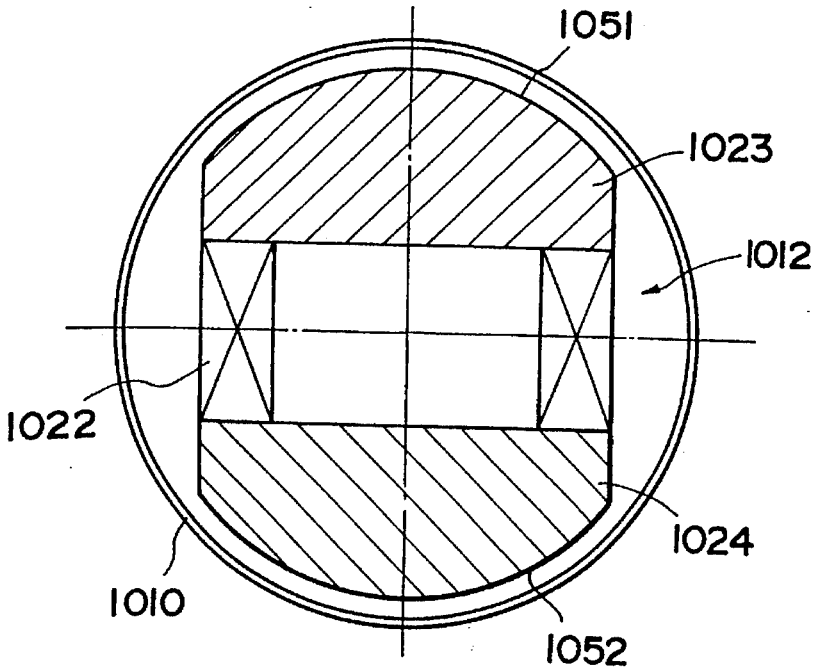
FIG. 31 is a fragmentary sectional view of another embodiment comprising a coil assembly wherein the core has a modified shape in section.

As previously stated, the core of the coil is used to give an increased density to the magnetic flux to be produced by the coil and to form a magnetic path for guiding the flux to the heat roller. It is therefore desired that the core be positioned close to the roller wall over a large area with a minimized gap formed therebetween. FIG. 27 shows a coil assembly 612 wherein opposite ends 650, 650 of a core 623 each have a circular-arc face in conformity with the curve of the inner surface of a heat roller 610, instead of a flat face. FIG. 28 shows a coil assembly 712 wherein opposite end faces 750, 751 of a core 723 are made circular-arc in conformity with the curve of the inner surface of a heat roller 710, and one of the end faces, 751, is larger than the other end face 750 so as to be close to the wall of the roller 710 over an increased area. FIG. 29 shows a coil assembly 812 wherein a core 823 is fabricated from two core segments 823*a*, 823*b* and has opposite end faces 851, 852 which are made circular-arc in conformity with the curve of the inner surface of a heat roller 810 and which are larger than the end faces 650 of the core 623 shown in FIG. 27 so as to be positioned close to the wall of the roller 810 over an increased area. FIG. 30 shows a coil assembly 912 wherein a core 923 is provided only on the top of a coil 922 as illustrated. The core 923 has an end face 951 which is made circular-arc in conformity with the curve of the inner surface of a heat roller 910 and thereby made positionable close to the wall of the roller 910 over a large area. FIG. 31 shows a coil assembly 1012 wherein cores 1023, 1024 are arranged on the top and bottom of a coil 1022, respectively, as illustrated. The cores 1023, 1024 respectively have end faces 1051, 1052 which are made circular-arc in conformity with the curve of the inner surface of a heat roller 1010 and made positionable close to the wall of the roller 1010 over an increased area.

Figure 32:
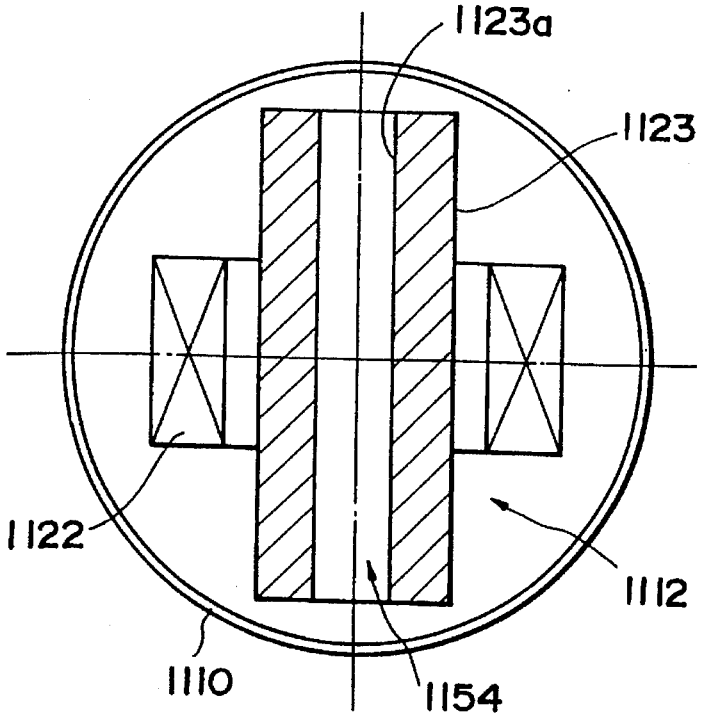
FIG. 32 is a fragmentary sectional view of another embodiment comprising a coil assembly wherein the core has a modified shape in section.
Figure 33:
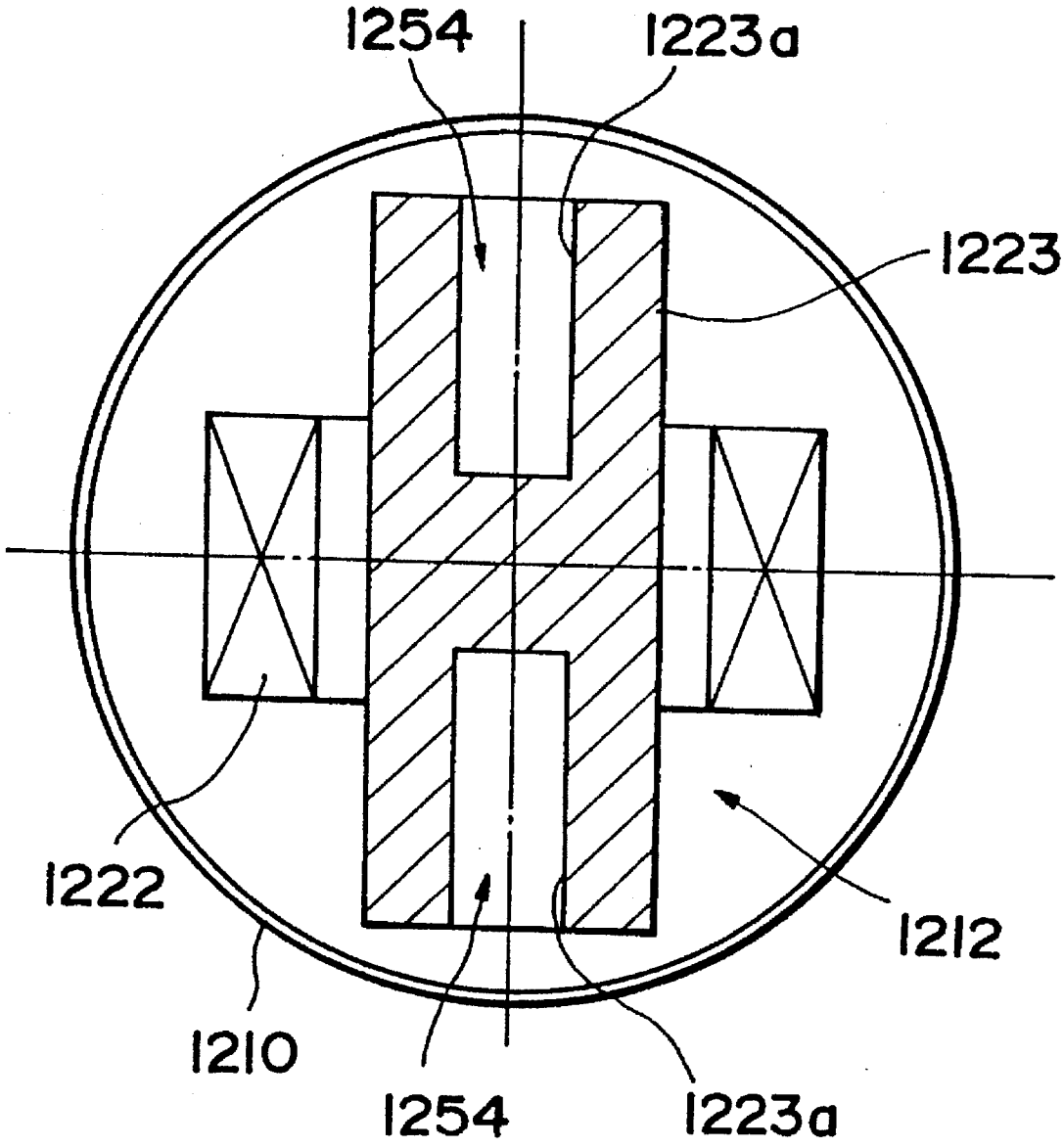
FIG. 33 is a fragmentary sectional view of another embodiment comprising a coil assembly wherein the core has a modified shape in section.

FIGS. 32 and 33 are fragmentary sectional views showing other embodiments which are modified in the sectional configuration of the core of the coil assembly.

As previously stated, the core of the coil is used to give an increased density to the magnetic flux to be produced by the coil and to form a magnetic path for guiding the flux to the heat roller. The magnetic flux passing through the interior of the core concentrates on the skin of the core owing to the skin effect of electromagnetic induction. It is therefore likely that the central portion of the core will not contribute to its function in the case where the heat roller has a large diameter and the core has a large thickness, or the high-frequency current used has a high frequency. FIG. 32 shows a coil assembly 1112 wherein a core 1123 has a bore 1123*a* centrally extending therethrough to form an air gap 1154 in the center of the core 1123. FIG. 33 shows a coil assembly 1212 wherein a core 1223 is formed with a bore 1223*a* extending from each end thereof and having a closed end to provide an air gap 1254 in the center of the core 1223.

Figure 34:
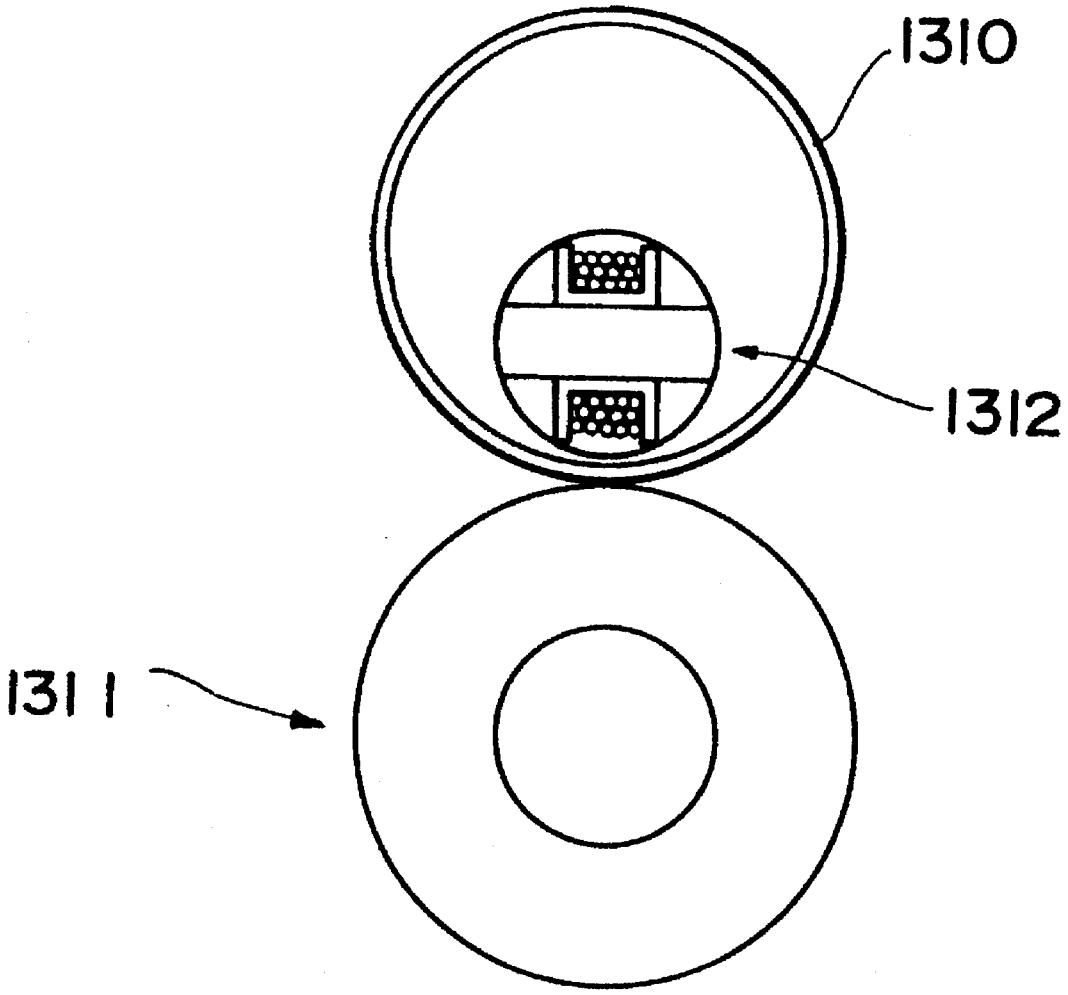
FIG. 34 is a sectional view of another embodiment comprising a coil assembly which is altered in size and position relative to the heat roller.

FIG. 34 is a view in section of another embodiment comprising a coil assembly which is altered in size and position. With the foregoing embodiments, the holder for holding the coil assemblies is disposed coaxially with the heat roller, whereas according to the present embodiment, the coil assembly 1312 is positioned eccentrically of a heat roller 1310 closer toward a pressure roller 1311. In this case, the magnetic flux produced by the coil assembly 1312 converges to a higher density toward the nip of the rollers 1310, 1311 than toward any other circumferential portion of the heat roller 1310, with the result that the nip portion produces the largest quantity of heat to achieve an improved electro-thermal conversion efficiency.

Although the coils of the plurality of coil assemblies are electrically connected together in series according to the foregoing embodiments, the connection is not limited to this mode, but the coils of the coil assemblies may be electrically connected in parallel so as to be turned on or off independently of one another. With this connection, the number of coil assemblies to be energized is selectively variable in accordance with the size of sheets to avoid heat generation of an unnecessary portion along the direction of the axis of the heat roller. A large number of (e.g., eight) coil assemblies of the same size may be used, or those of different sizes may be provided according to the size of sheets. For example, cores having a different width in the axial direction may be provided. A reduced production cost can be achieved in the former case, while the latter case effects fixing most suitably in accordance with the size of sheets.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An induction heating fixing device comprising:

a heat roller formed by an electrically conductive member and having a hollow space in its interior;

a pressure roller disposed in pressing contact with the heat roller;

a core disposed within the heat roller in a direction orthogonal to the axis of rotation of the heat roller to form a magnetic path for guiding magnetic flux in said direction orthogonal to the axis of rotation of the heat roller;

a coil provided around the core; and a circuit for passing an alternating current through the coil.

2. An induction heating fixing device as claimed in claim 1, wherein said coil has first and second opposed sides which are parallel to said axis of rotation of said heat roller, and wherein said device further comprises a thermistor which is pressed against the surface of the heat roller so as to be opposed to said first side of the coil with the wall of the heat roller interposed therebetween.

3. An induction heating fixing device as claimed in claim 2, wherein said second side of said coil is opposed to the pressure roller.

4. An induction heating fixing device as claimed in claim 3, wherein said circuit supplies an alternating current based on an output from the thermistor.

5. An induction heating fixing device as claimed in claim 1, further comprising a temperature fuse which is pressed against the surface of the heat roller so as to be opposed to a side of the coil which is parallel to the axis of rotation of said heat roller with the wall of the heat roller interposed therebetween.

6. An induction heating fixing device as claimed in claim 1, further comprising a second core having a width larger than that of the first core in the axial direction and a second coil provided around the second core, the first core and the second core being aligned axially of the heat roller so that each coil has a side thereof which is parallel to the axis of rotation of said heat roller opposed to the pressure roller.

7. An induction heating fixing device comprising:

a heat roller formed by an electrically conductive member and having a hollow space in its interior;

a pressure roller disposed in pressing contact with the heat roller;

a plurality of coil assemblies disposed within the heat roller to produce magnetic flux in a direction orthogonal to the axis of rotation of the heat roller; and a circuit which passes an alternating current through the coil.

8. An induction heating fixing device as claimed in claim 7, wherein said coil assemblies are so arranged that each two adjacent coil assemblies produce flux in opposite directions.

9. An induction heating fixing device as claimed in claim 7, wherein said circuit selectively passes an alternating current through each coil.

10. An induction heating roller comprising:

an electrically conductive roller having a hollow space in its interior;

a coil formed by winding a wire; and a holder which holds said coil within the heat roller so that individual turns of the wire each extend along planes parallel to the axis of rotation of the heat roller.

* * * * *